US006589085B2

(12) United States Patent
Matsuda et al.

(10) Patent No.: US 6,589,085 B2
(45) Date of Patent: Jul. 8, 2003

(54) JET-PROPULSION WATERCRAFT

(75) Inventors: Yoshimoto Matsuda, Kobe (JP); Kiyoaki Maeda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/921,085

(22) Filed: Aug. 2, 2001

(65) Prior Publication Data

US 2002/0016109 A1 Feb. 7, 2002

(30) Foreign Application Priority Data

Aug. 2, 2000 (JP) ..... 2000-234032
Aug. 8, 2000 (JP) ..... 2000-240279
Aug. 21, 2000 (JP) ..... 2000-249219

(51) Int. Cl.[7] ..... B63H 21/22
(52) U.S. Cl. ..... 440/1; 440/87
(58) Field of Search ..... 440/1, 2, 38, 40–42, 440/84–87; 114/144 R

(56) References Cited

U.S. PATENT DOCUMENTS 6,231,410 B1 * 5/2001 Bernier et al. ..... 440/1
6,336,833 B1 * 1/2002 Rheault et al. ..... 440/1

FOREIGN PATENT DOCUMENTS

JP P2001-191992 A 7/2001
JP P2001-354195 A 12/2001

* cited by examiner

*Primary Examiner*—Ed Swinehart
(74) *Attorney, Agent, or Firm*—Marshall, Gerstein & Borun

(57) ABSTRACT

The present invention provides a lightweight and simply-configured watercraft of a jet-propulsion type that can maintain steering capability according to the cruising speed of the watercraft even when a throttle-close operation is performed and the amount of water ejected from a water jet pump is thereby reduced. When a throttle-close operation and a steering handle operation are detected, steering assist mode control according to the present invention is executed to increase the engine speed. The increasing speed of the engine speed is adjustably increased to subdue the rate of change between the cruising speed at the detection of the operations and the cruising speed to be changed by the control, and the watercraft can continue to turn smoothly under the control.

32 Claims, 28 Drawing Sheets

| | CYLINDER #1 | | CYLINDER #2 | | CYLINDER #3 | |
|---|---|---|---|---|---|---|
| | IGNITION | INJECTION | IGNITION | INJECTION | IGNITION | INJECTION |
| PATTERN #1 | ○ | ○ | × | × | ○ | ○ |
| PATTERN #2 | ○ | ○ | ○ | × | ○ | ○ |
| PATTERN #3 | ○ | ○ | × | ○ | ○ | ○ |
| PATTERN #4 | × | × | ○ | ○ | × | × |
| PATTERN #5 | ○ | × | ○ | ○ | ○ | × |
| PATTERN #6 | × | × | ○ | ○ | × | ○ |

Fig. 16

JET-PROPULSION WATERCRAFT

BACKGROUND OF THE INVENTION

1. Field of the Invention

The present invention relates to a jet-propulsion watercraft which ejects water rearward and planes on a water surface as the resulting reaction. More particularly, the present invention relates to a jet-propulsion watercraft that can maintain steering capability even when the throttle is operated in the closed position and propulsion force is thereby reduced.

2. Description of the Related Art

In recent years, so-called jet-propulsion personal watercraft (PWC) have been widely used in leisure, sport, rescue activities, and the like. The personal watercraft is configured to have a water jet pump that pressurizes and accelerates water sucked from a water intake generally provided on a bottom of a hull and ejects it rearward from an outlet port. Thereby, the personal watercraft is propelled.

In the personal watercraft, in association with a steering handle of a general bar type, a steering nozzle provided behind the outlet port of the water jet pump is swung either to the right or left, to change the ejecting direction of the water to the right or to the left, thereby turning the watercraft.

A deflector is retractably provided behind the steering nozzle for blocking the water ejected from the steering nozzle. The deflector is moved downward to deflect the ejected water forward, and as the resulting reaction, the personal watercraft moves rearward. In some watercraft, in order to move rearward, a water flow is formed so as to flow from an opening provided laterally of the deflector along a transom board to reduce the water pressure in an area behind the watercraft.

In the above-described personal watercraft, when the throttle is moved to a substantially fully closed position and the water ejected from the water jet pump is thereby reduced, during forward movement and rearward movement, the propulsion force necessary for turning the watercraft is correspondingly reduced, and the steering capability of the watercraft is therefore reduced until the throttle is re-opened.

To solve the above-described condition with a mechanical structure, the applicant disclosed a jet-propulsion personal watercraft comprising a steering component for an auxiliary steering system which operates in association with the steering handle in addition to a steering nozzle for the main steering system in Japanese Patent Application No. Hei. 2000-6708.

Also, for the purpose of achieving a lightweight watercraft, the applicant disclosed a jet-propulsion personal watercraft in Japanese Patent Application No. Hei. 2000-173232, in which a sensor is adapted to detect a throttle-close operation, a steering operation, or the like, and an engine speed is increased according to the detection.

SUMMARY OF THE INVENTION

The present invention addresses the above-described condition, and an object of the present invention is to provide a jet-propulsion watercraft, which can maintain steering capability according to the cruising speed thereof even while an operation which closes the throttle is performed and the amount of water ejected from a water jet pump is thereby reduced. More specifically, the watercraft is adapted to execute a control for increasing the engine speed while the throttle-close operation and the steering handle operation are detected. The engine speed increase is controlled so that the rate of change upon the control is subdued making the watercraft continue to turn smoothly.

According to the present invention, there is provided a jet-propulsion watercraft comprising: a water jet pump that pressurizes and accelerates sucked water and ejects the water from an outlet port provided behind the water jet pump to propel the watercraft as a reaction of the ejecting water; an engine for driving the water jet pump; a steering operation means that operates in association with a steering nozzle of the water jet pump; a steering position sensor for detecting a predetermined steering position of the steering operation means; a throttle-close operation sensor for detecting a throttle-close operation; a cruising speed obtaining means for obtaining a cruising speed of the watercraft; and an electric control unit, wherein the electric control unit is adapted to increase the engine speed to a predetermined engine speed during the detection of the predetermined steering position by the steering position sensor and the detection of the throttle-close operation by the throttle-close operation sensor while changing an increasing speed of the engine speed according to the cruising speed obtained by the cruising speed obtaining means.

According to the jet-propulsion watercraft of the present invention, the engine speed is increased to the predetermined engine speed while the watercraft is steered, this operation is detected by the steering position sensor, and while the throttle-close operation is detected by the throttle-close operation sensor. Therefore, the water sufficient to turn the watercraft is ejected from the water jet pump, and the steering capability can be maintained even while the throttle-close operation is performed. Also, since the increasing speed of the engine speed is changed according to the cruising speed obtained by the cruising speed obtaining means, the ejected water amount adapted to the cruising speed can be obtained, and the rider is given improved steering feeling.

Herein, control for increasing the engine speed is referred to as "steering assist mode control", and the "throttle-close operation" means that operation is performed to bring the throttle toward a closed position by a predetermined amount or more.

It should be noted that the throttle-close operation sensor of the present invention is not limited to the engine speed sensor and the throttle position sensor. For example, it is possible to use a sensor placed in a system connecting a throttle lever and a throttle valve for detecting an operation of the system while the throttle-close operation is performed. Also, it is possible to use a sensor for detecting an air-intake pressure and an air-intake amount of the engine.

Under the steering assist mode control, the engine speed can be increased by changing at least any of the fuel injection timing of the fuel injection system of the engine, the ignition timing of an ignition system of the engine, and the fuel injection amount of the fuel injection system of the engine. In this case, the engine speed can be increased without actual operation of the throttle.

In the jet-propulsion watercraft, the speed for increasing the engine speed to the predetermined engine speed according to the change in the cruising speed may be changed stepwise.

It is preferable that in the jet-propulsion watercraft, smaller increasing speeds of the engine speed are set for higher cruising speeds. Thereby, the change in the cruising speed occurring in transition to the steering assist mode control can be subdued, and the steering feeling under the control is improved.

In the jet-propulsion watercraft, a cruising speed sensor for detecting the cruising speed of the watercraft may be used as the cruising speed obtaining means. Also, the cruising speed may be calculated from the engine speed.

The jet-propulsion watercraft may further comprise: an increasing speed table that prestores an increasing speed of the engine speed according to the cruising speed. The increasing speed according to the cruising speed obtained by the cruising speed obtaining means may be read from the increasing speed table and the engine speed may be increased to the predetermined engine speed based on the increasing speed read from the increasing speed table. Thereby, the control for changing the increasing speed of the engine speed can be more simply executed. To obtain the stored increasing speeds of the engine speed that give preferable steering feeling, the engine speeds associated with a variety of actual cruising speeds are experimentally increased to the predetermined engine speed.

The increasing speed table may be adapted to divide a predetermined cruising speed range into a plurality of speed ranges and set smaller increasing speeds of the engine speeds for higher speed ranges.

More specifically, the increasing speed table may be adapted to divide a predetermined cruising speed range into first, second, and third speed ranges which are set in the order from low to high, and store smaller increasing speeds set for higher speed ranges. In this case, when the obtained cruising speed is in the first speed range, the engine speed is increased to the predetermined engine speed based on the first increasing speed. When the obtained cruising speed is in the second speed range, the engine speed is increased based on a second increasing speed smaller than the first increasing speed, and in the middle thereof, when the cruising speed decreases to the first speed range, the increasing speed is switched from the second increasing speed to the first increasing speed and in time, the engine speed reaches the predetermined engine speed. Likewise, when the cruising speed is in the third speed range, the engine speed is increased based on a third increasing speed smaller than the second increasing speed, and in the middle thereof, when the cruising speed decreases to the second speed range, the increasing speed is switched from the third increasing speed to the second increasing speed. Then, when the cruising speed further decreases to the first speed range, the increasing speed is switched from the second increasing speed to the first increasing speed, and in time, the engine speed reaches the predetermined engine speed.

According to the present invention, there is also provided a jet-propulsion watercraft comprising: a water jet pump that pressurizes and accelerates sucked water and ejects the water from an outlet port provided behind the water jet pump to propel the watercraft as a reaction of the ejecting water; an engine for driving the water jet pump; a steering operation means that operates in association with a steering nozzle of the water jet pump; a steering position sensor for detecting a predetermined steering position of the steering operation means; a throttle-close operation sensor for detecting a throttle-close operation; an obtaining means for obtaining one of a cruising speed of the watercraft and torque of the engine; and an electric control unit, wherein the electric control unit is adapted to increase the engine speed during the detection of the predetermined steering position by the steering position sensor and the detection of the throttle-close operation by the throttle-close operation sensor so that the value obtained by the obtaining means becomes a predetermined target value while changing an increasing speed of the engine speed based on a difference value between a value obtained by the obtaining means and the target value.

According to the jet-propulsion watercraft, the engine speed is increased so that the value obtained by the obtaining means becomes the target value while the steering operation means is operated, this operation is detected by the steering position sensor, and while the throttle-close operation is detected by the throttle-close operation sensor. Therefore, the water sufficient to turn the watercraft is ejected from the water jet pump, and the steering capability can be maintained even while the throttle-close operation is performed. Also, since the increasing speed of the engine speed is changed according to the difference value between the value obtained by the obtaining means and the corresponding target value, the ejected water amount adapted to the actual cruising speed or the engine torque in substitution for the cruising speed can be obtained, and the rider is given improved steering feeling.

It is preferable that in the jet-propulsion watercraft, the smaller increasing speeds of the engine speed are set for larger difference values. Thereby, the change in the cruising speed in transition to the steering assist mode control can be subdued, and the steering feeling under the control is improved.

It is preferable that the increasing speed of the engine speed is set smaller than usual when the difference value is larger than a predetermined value. In this case, two different increasing speeds may be provided. The larger increasing speed is used when the difference value is not larger than the predetermined value for, for example, a normal mode. On the other hand, the smaller increasing speed is used when the difference value is larger than the predetermined value for an extended mode which extends the time required for increasing the engine speed up to the predetermined target value from usual control condition, i.e., the normal mode.

The jet-propulsion watercraft may further comprise: a target value table that prestores a target value for one of the cruising speed of the watercraft and the torque of the engine, and the target value according to the cruising speed or the engine torque may be read from the target value table, and the engine speed may be increased so that the cruising speed or the torque becomes the read target value. Thereby, the control for setting the target value can be simplified. To obtain the target value for the cruising speed or the torque that gives the rider preferable steering feeling, the engine speeds associated with a variety of cruising speeds or torques are experimentally increased.

The jet-propulsion watercraft may further comprises an engine speed sensor for detecting the engine speed to calculate the torque from the engine speed detected by the sensor (and/or throttle position). Likewise, the cruising speed can be calculated from the engine speed.

For the calculation of the torque from the engine speed, the obtaining means may comprise a torque conversion table that prestores the relationship between the engine speed and the torque, and the torque according to the detected engine speed may be read from the torque conversion table. The table may be replaced by an arithmetic expression of torque using the engine speed and the throttle position as parameters. It should be noted that the torque can be simply calculated only from the engine speed because the throttle position is substantially unnecessary at the throttle-close operation. Further, the crankshaft of the engine may be provided with a transducer for directly obtaining the torque. The same is the case with the cruising speed.

In the jet-propulsion watercraft, the obtaining means may comprise an offset table that prestores an offset value used for offsetting the torque stored in the torque conversion table according to acceleration of the engine; and an acceleration obtaining means for obtaining the acceleration of the engine, and the torque read from the torque conversion table may be offset according to the acceleration. Thereby, more accurate torque allowing for the inertia of the watercraft can be obtained.

In the jet-propulsion watercraft, the acceleration obtaining means may comprise an engine speed memory for sequentially storing the engine speed detected by the engine speed sensor; a calculating means for calculating a difference value between two engine speeds stored in the engine speed memory; a difference value memory for sequentially storing the difference value calculated by the calculating means; and a cumulating means for cumulating difference values stored in the difference value memory, and the acceleration of the engine may be calculated based on the cumulated value. In the engine speed memory, all of the engine speeds detected by the engine speed sensor in a predetermined time cycle may be stored or they may be partially stored. Further, the engine speed sensor may detect the engine speed for every control clock or partially detect the engine speed.

In the jet-propulsion watercraft, the engine may be adapted not to conduct combustion in part of or all of a plurality of cylinders of the engine for a predetermined time period, that is, to conduct "partial-combustion", in order to set the increasing speed of the engine speed smaller. Thereby, when the throttle is re-opened thereafter, the engine speed can be re-increased quickly. Also, the ignition timing and/or the injection timing in part of or all of the plurality of cylinders may be changed.

According to the present invention, there is further provided a jet-propulsion watercraft comprising: a water jet pump that pressurizes and accelerates sucked water and ejects the water from an outlet port provided behind the water jet pump to propel the watercraft as a reaction of the ejecting water; an engine for driving the water jet pump; a steering operation means that operates in association with a steering nozzle of the water jet pump; a steering position sensor for detecting a predetermined steering position of the steering operation means; a throttle-close operation sensor for detecting a throttle-close operation; an engine speed sensor for sequentially detecting the engine speed; and an electric control unit, wherein during the detection of the predetermined steering position by the steering position sensor and the detection of the throttle-close operation by the throttle-close operation sensor, the electric control unit is adapted to judge whether or not a value associated with the engine speed detected in a second period before a first period between the detection point of these operations and a point before a given period from the detection point is larger than a predetermined value, and to increase the engine speed while judging that the value is larger than the predetermined value.

According to the jet-propulsion watercraft of the present invention, the engine speed is increased to the predetermined engine speed while the watercraft is steered, this operation is detected by the steering position sensor, and while the throttle-close operation is detected by the throttle-close operation sensor. Therefore, the water sufficient to turn the watercraft is ejected from the water jet pump, and the steering capability can be maintained even when the throttle-close operation is performed. Also, since the value associated with the engine speeds in a predetermined period (second period) before the detection of the throttle-close operation and the steering operation is used in judgment as to whether or not to increase the engine speed, this value may be substituted for the cruising speed without being influenced by the throttle work. Further, since the engine speeds in the second period before the first period hardly include the engine speeds quickly decreased just after the throttle-close operation, that is, the value associated with the engine speeds in the second period can be used as a more accurate value in substitution for the cruising speed.

In the jet-propulsion watercraft, the value associated with the engine speed in the second period may comprise a statistical value of a plurality of engine speeds in the second period. Also, the value associated with the engine speed in the second period may comprise an average value of the engine speeds in the second period. In this case, the calculation process of the engine speeds is performed simply and in a short time.

It is preferable that in the jet-propulsion watercraft, the first period is approximately 0.5 second and the second period is approximately 3 to 5 seconds.

According to the present invention, there is still further provided a jet-propulsion watercraft comprising: a water jet pump that pressurizes and accelerates sucked water and ejects the water from an outlet port provided behind the water jet pump to propel the watercraft as a reaction of the ejecting water; an engine for driving the water jet pump; a steering operation means that operates in association with a steering nozzle of the water jet pump; a steering position sensor for detecting a predetermined steering position of the steering operation means; a throttle-close operation sensor for detecting a throttle-close operation; a cruising speed obtaining means for obtaining a cruising speed of the watercraft; and an electric control unit, wherein the electric control unit is adapted to increase the engine speed upon an elapse of a delay time according to the cruising speed obtained by the cruising speed obtaining means after the steering position sensor detects the predetermined steering position and the throttle-close operation sensor detects the throttle-close operation.

According to the jet-propulsion watercraft, the engine speed is increased while the watercraft is steered, this operation is detected by the steering position sensor, and while the throttle-close operation is detected by the throttle-close operation sensor. Therefore, the water sufficient to turn the watercraft is ejected from the water jet pump, and the steering capability can be maintained even when the throttle-close operation is performed. Also, since the timing of the start of increasing the engine speed is delayed according to the cruising speed obtained by the cruising speed obtaining means, the cruising speed decreases during the delay time even when the watercraft is cruising at a speed relatively larger than the upper limit to which engine speed is increased. Consequently, transition to the steering assist mode control can be improved.

The timing of the start of increasing the engine speed may be delayed proportional the cruising speed and a cruising speed sensor for detecting the cruising speed may be used as the cruising speed obtaining means. Also, the cruising speed may be calculated from the engine speed.

The jet-propulsion watercraft may further include a delay time table that prestores delay time according to the cruising speed, and the delay time according to the obtained cruising speed may be read from the delay time table and the timing of start of increasing the engine speed may be delayed by the read delay time. Thereby, the control for the delay in the start of increasing the engine speed can be simplified. The delay time according to the cruising speed can be obtained by actually measuring the times that give the rider preferable steering feeling.

The above and further objects and features of the invention will more fully be apparent from the following detailed description with accompanying drawings.

BRIEF DESCRIPTION OF THE DRAWINGS

FIG. 16 is a diagram showing an example of a method for adjusting combustion of the engine in each cylinder to extend the time during which the engine speed is increased;

FIGS. 24A–24C are views each showing the timing(s) at which the throttle-close operation and the steering operation are performed and ON/OFF of the steering assist mode control according to the corresponding cruising speed, wherein FIG. 24A shows the state in which the throttle-close operation and the steering operation are performed substantially at the same time when the watercraft is cruising at a high speed, FIG. 24B shows the state in which the throttle-close operation and the steering operation are performed substantially at the same time while the watercraft is cruising at a low speed, and FIG. 24C shows the state in which the throttle-close operation is performed in the high-speed cruising state and the steering operation is performed after the watercraft is moved by inertia for a certain time period;

DETAILED DESCRIPTION OF THE PREFERRED EMBODIMENT

Hereinafter, a jet-propulsion watercraft according to embodiments of the present invention will be described with reference to accompanying drawings. In the embodiments below, a personal watercraft will be described.

First Embodiment

Figure 1:
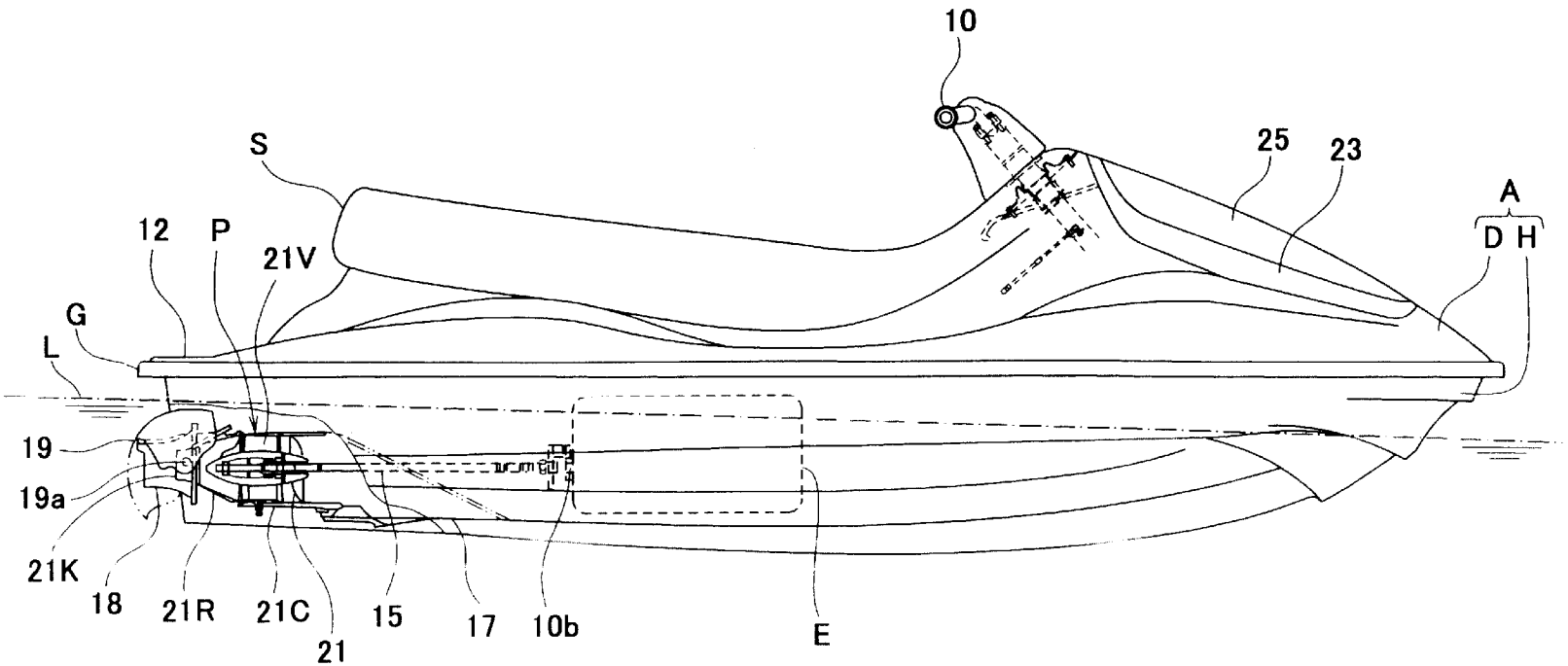
FIG. 1 is a side view showing an entire personal watercraft with a steering mechanism according to an embodiment of the present invention.
Figure 2:
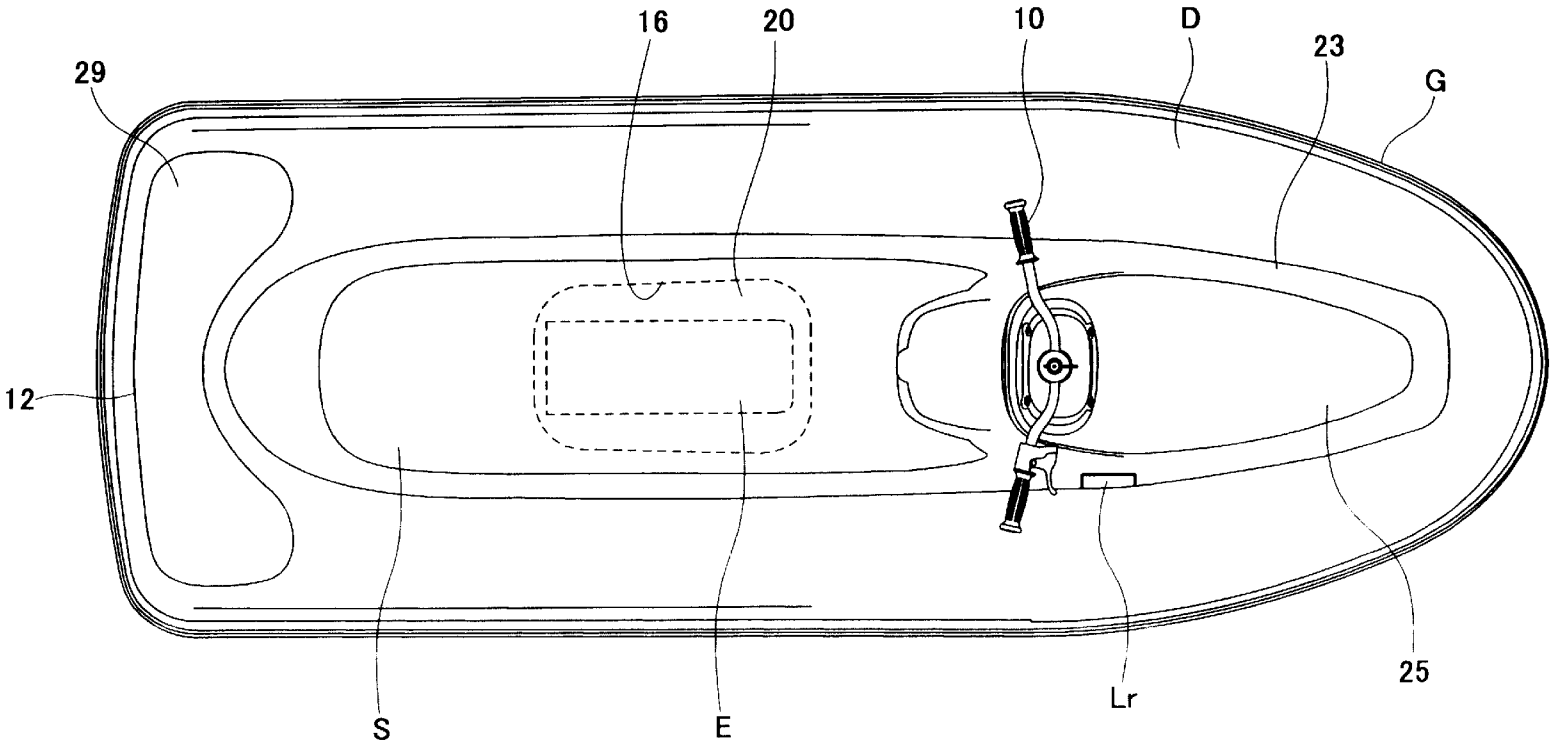
FIG. 2 is a plan view showing the entire personal watercraft of FIG. 1.

FIG. 1 is a side view showing an entire personal watercraft according to an embodiment of the present invention and FIG. 2 is a plan view of FIG. 1. Referring now to FIGS. 1, 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends in the longitudinal direction of the body A, and a riding seat S is provided above the opening 16 such that it covers the opening 16 from above. An engine E is provided in a chamber 20 surrounded by the hull H and the deck D below the seat S.

The engine E includes multiple cylinders (e.g., three-cylinders). As shown in FIG. 1, a crankshaft 10*b* of the engine E is mounted along the longitudinal direction of the body A. An output end of the crankshaft 10*b* is rotatably coupled integrally with a pump shaft of a water jet pump P through a propeller shaft 15. An impeller 21 is mounted on the pump shaft of the water jet pump P. The impeller 21 is covered with a pump casing 21C on the outer periphery thereof.

A water intake 17 is provided on the bottom of the hull H. The water is sucked from the water intake 17 and fed to the water jet pump P through a water intake passage. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining propulsion force. In FIG. 1, reference numeral 21V denotes fairing vanes for fairing water flow behind the impeller 21.

As shown in FIGS. 1, 2, reference numeral 10 denotes a bar-type steering handle as a steering operation means. The handle 10 operates in association with the steering nozzle 18 provided behind the pump nozzle 21R such that the steering nozzle 18 is swingable rightward or leftward. When the rider rotates the handle 10 clockwise or counterclockwise, the steering nozzle 18 is swung toward the respective opposite direction so that the watercraft can be turned to any desired direction when the water jet pump P is generating the propulsion force.

In FIGS. 1, 2, reference numeral 12 denotes a rear deck. The rear deck 12 is provided with an openable rear hatch cover 29. A rear compartment (not shown) with a small capacity is provided under the rear hatch cover 29. Reference numeral 23 denotes a front hatch cover. A front compartment (not shown) is provided under the front hatch cover 23 for storing equipment and the like. A hatch cover 25 is provided over the front hatch cover 23, thereby forming a two-layer cover. A life jacket and the like can be stored under the hatch cover 25 through an opening (not shown) provided in the rear end thereof.

As shown in FIG. 1, a bowl-shaped reverse deflector 19 is provided above the rear side of the steering nozzle 18 such that it can swing downward around a horizontally mounted swinging shaft 19*a*. In this embodiment, as shown in FIG. 2, a reverse switching lever Lr is provided in the vicinity of the handle 10 and at a portion of the body A that is forward of the handle 10 on the right side, for performing switching between forward movement and rearward movement of the watercraft.

Figure 3:
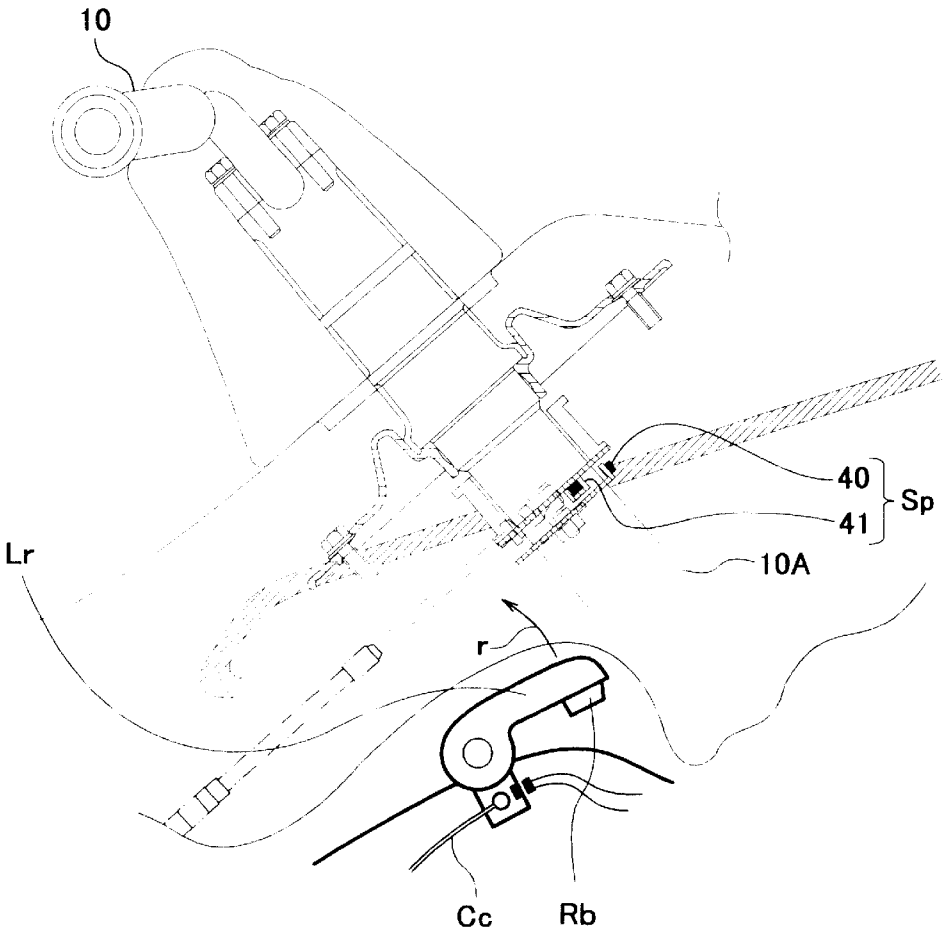
FIG. 3 is a partially enlarged cross-sectional view showing a steering mechanism of FIG. 1.

FIG. 3 is a partially enlarged cross-sectional view showing the steering mechanism of FIG. 1. As shown in FIG. 3, the reverse switching lever Lr is provided with a locking release button Rb at a tip end thereof for locking and releasing swing operation of the lever Lr. The rider presses the locking release button Rb and pivotally raises the reverse switching lever Lr as indicated by an arrow r around a swinging shaft, to pull a cable Cc connected at one end thereof to a base end of the reverse switching lever Lr. Thereby, the deflector 19 connected to the other end of the cable Cc is swung to a lower position rearward of the steering nozzle 18 and the water discharged rearward from the steering nozzle 18 is deflected forward. Thus, switching from forward movement to rearward movement is performed. In this state, upon the rider releasing the locking release button Rb, the raised position of the reverse switching lever Lr is locked and the watercraft is maintained in a rearward movement state. Then, in this state, when the rider re-presses the locking release button Rb and pivotally lowers the reverse switching lever Lr toward the opposite direction, the watercraft can move forward again.

Figure 4:
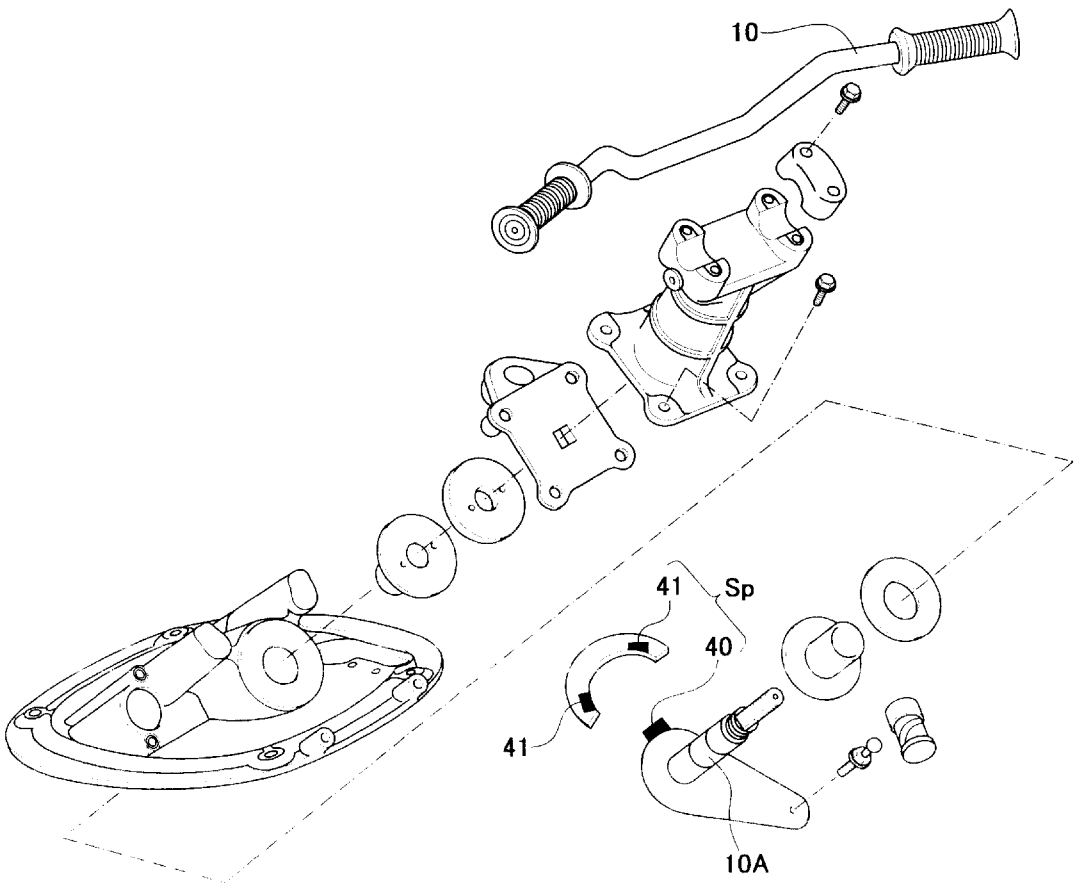
FIG. 4 is a partially exploded perspective view showing the steering mechanism of FIG. 3.

FIG. 4 is a partially exploded perspective view of the steering mechanism. In the personal watercraft of this embodiment, the steering mechanism is provided with a steering position sensor Sp. The steering position sensor Sp is constituted by a permanent magnet 40 and a pair of proximity switches 41. The permanent magnet 40 is attached to a portion of a circular-plate member fixed to a rotational shaft 10A of the steering handle 10. The proximity switches 41 are respectively provided at positions spaced apart from the permanent magnet 40 such that each of these switches forms a predetermined angle (for example, 20 degrees) clockwise or counterclockwise with respect to the permanent magnet 40. When the steering handle 10 is rotated by the predetermined angle and the permanent magnet 40 comes close to the corresponding proximity switch 41, the switch 41 is turned ON, thereby detecting steering operation. It should be noted that a potentiometer can be substituted for the position sensor Sp.

Figure 5:
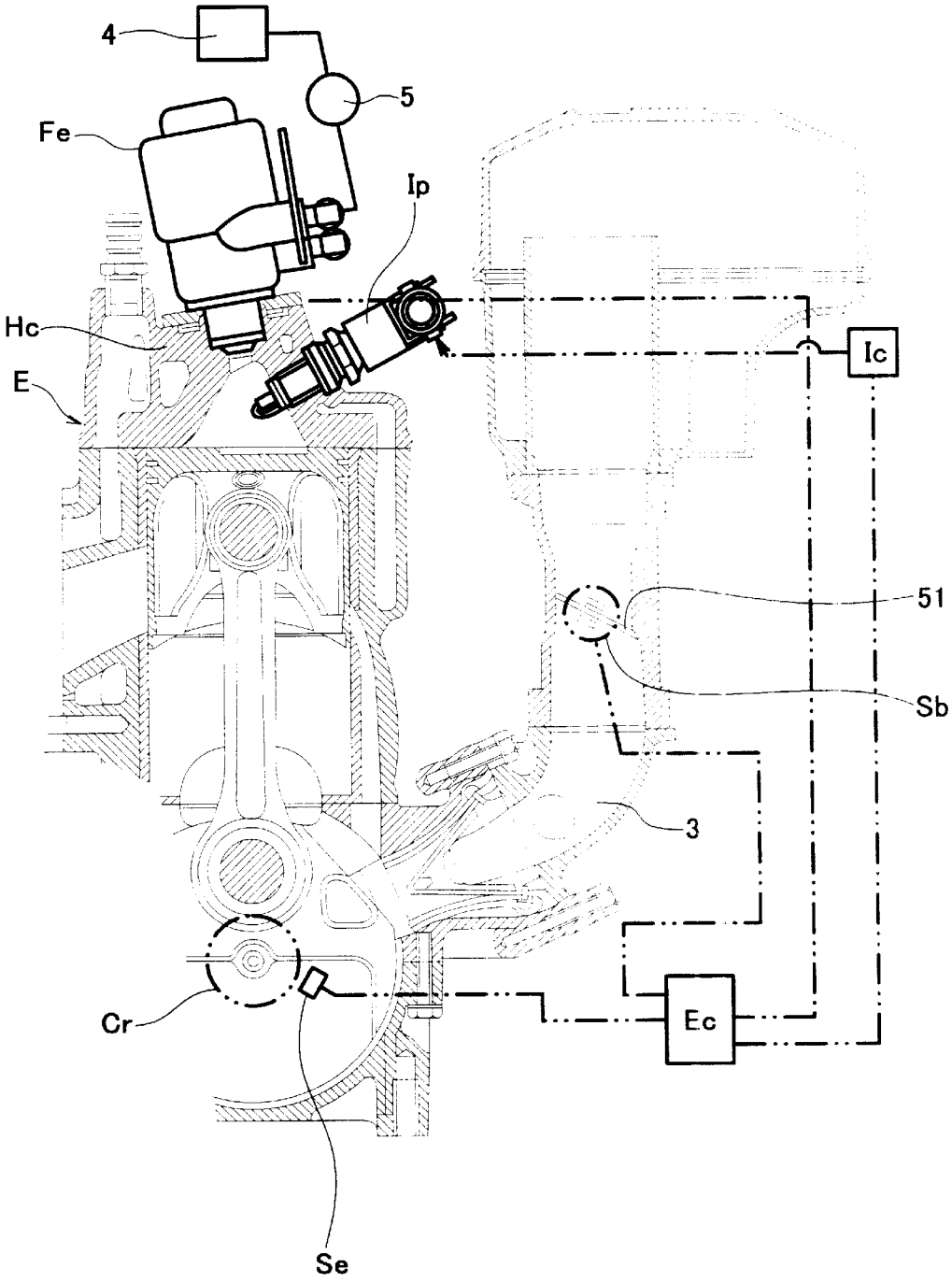
FIG. 5 is a cross-sectioned, partly schematic view showing a configuration of a control system of the personal watercraft according to one embodiment based on the relationship with the engine.
Figure 6:
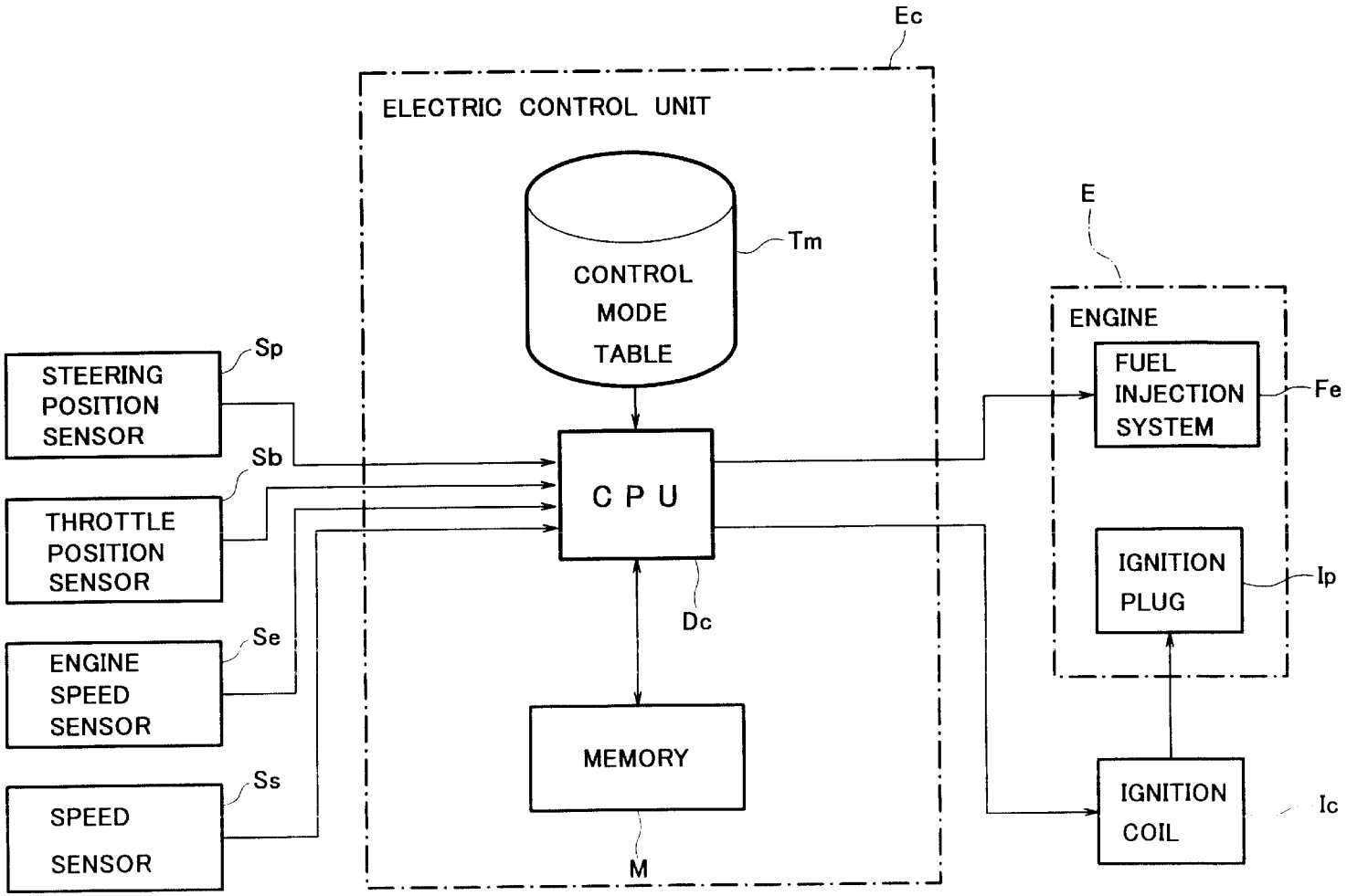
FIG. 6 is a block diagram showing the configuration of the control system of the personal watercraft according to one embodiment.

FIG. 5 is a view showing a configuration of a control system of the personal watercraft of this embodiment based on the relationship with the engine. FIG. 6 is a block diagram of the configuration of the control system of FIG. 5. As shown in FIGS. 5, 6, a throttle position sensor Sb is provided close to a butterfly valve 51 placed in an intake passage 3 of the engine E, for detecting that the butterfly valve 51 is closed to some degrees, i.e., throttle-close operation. An engine speed sensor Se is provided in the vicinity of the crankshaft Cr, for detecting the number of revolutions of the crankshaft Cr, i.e., the engine speed of the engine E.

The steering position sensor Sp, the throttle position sensor Sb, and the engine speed sensor Se are respectively connected to a CPU (central processing unit) Dc of an electric control unit Ec through signal lines (electric wires). A signal indicating that the steering operation, the throttle-close operation, or the engine speed has been detected by the steering position sensor Sp, the throttle position sensor Sb, or the engine speed sensor Se, is sent to the CPU Dc.

The CPU Dc is connected to a fuel injection system Fe provided in a cylinder head Hc of the engine E and an ignition coil Ic through signal lines (electric wires). The ignition coil Ic is connected to an ignition plug Ip of the engine E through an electric wire (high-tension cord). In FIG. 5, reference numeral 4 denotes a fuel tank and reference numeral 5 denotes a fuel pump.

Thus, the personal watercraft of this embodiment includes the above-identified hardware configuration. As described below, when predetermined conditions such as the throttle-close operation occur, transition to the steering assist mode control takes place. The personal watercraft has a function of maintaining steering capability even while the throttle is placed in the closed state. This function is stored in a memory M (see FIG. 6) built in the electric control unit Ec as a computer program and performed by making the CPU Dc execute the computer program. Subsequently, a control process according to the computer program will be described with reference to flowcharts of FIGS. 7, 8.

Figure 7:
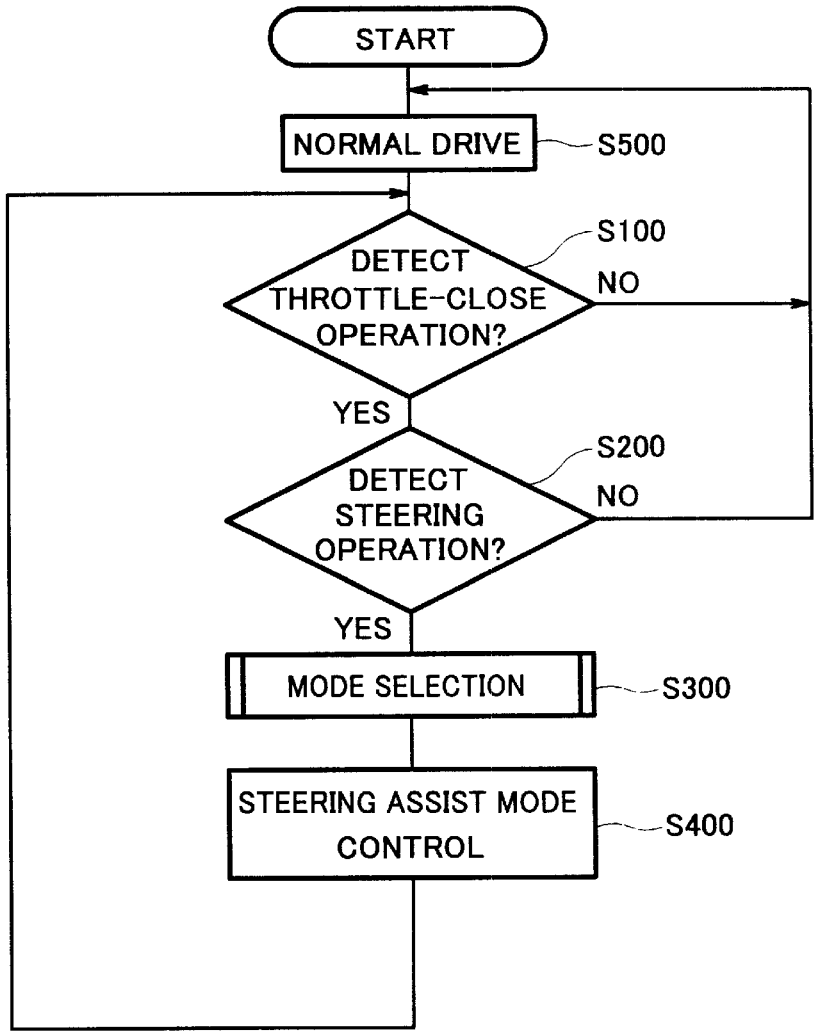
FIG. 7 is a flowchart showing a control process performed under steering assist mode control of the personal watercraft according to the embodiment.
Figure 8:
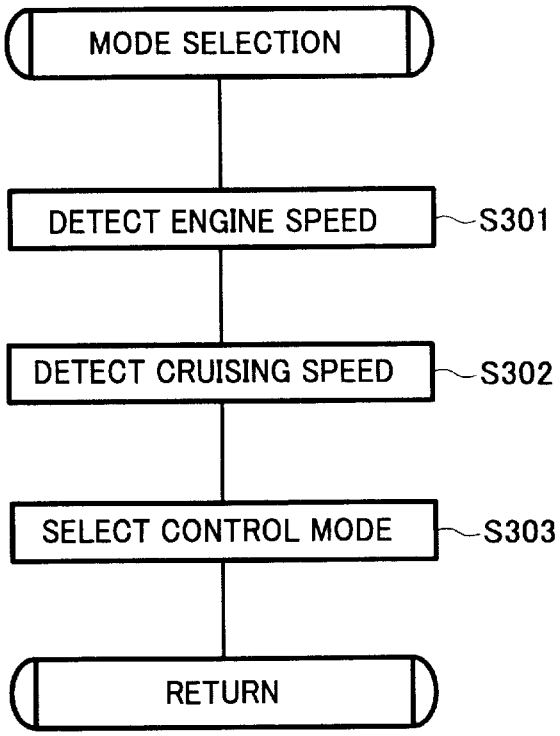
FIG. 8 is a flowchart showing a control mode selecting process of FIG. 7.

Referring to FIG. 7, the flowchart shows the control process performed by the CPU Dc under the steering assist mode control while the watercraft is moving forward. When the personal watercraft of this embodiment is moving forward, first of all, the CPU Dc judges whether or not the throttle position sensor Sb has detected that the rider performed the throttle-close operation (Step S100).

When judging that the throttle-close operation has been detected by the throttle position sensor Sb ("YES" in Step S100), the CPU Dc judges whether or not the steering position sensor Sp has detected that the rider rotated the steering handle 10 by the predetermined angle to the right or to the left (Step S200).

When judging that the throttle-close operation has not been detected ("NO" in Step S100) or the steering operation has not been detected ("NO" in Step S200), the CPU DC maintains a current drive state, i.e., a normal drive state (Step S500).

On the other hand, when judging that the steering operation has been detected ("YES" in Step S200), the CPU Dc executes a control mode selecting process mentioned later (Step S300), and starts the steering assist mode control according to the selected control mode (Step S400).

Specifically, under the steering assist mode control, the CPU Dc executes control to change the fuel injection timing and the ignition timing of the engine E, or these timings and the fuel injection amount, thereby increasing the engine speed. More specifically, the CPU Dc executes control to change the increasing speed according to the selected control mode.

In this embodiment, in order to increase the engine speed, it is desirable to set faster injection timing and increase the fuel injection amount, but the present invention is not limited to these. Besides, in view of a turning characteristic of the personal watercraft, a characteristic due to the hull shape of the watercraft, and the like, the engine speed may be increased up to approximately 2500–3500 rpm. For example, the engine speed may be fixed at approximately 3000 rpm or may vary depending on the cruising state of the watercraft.

When the engine speed is equal to or smaller than the idling speed (for example, approximately 800–2000 rpm), it is possible to prevent the steering assist mode control from being executed in the idling state. This is because the propulsion force is unnecessary in the idling state in which the watercraft is not moving. It is also possible to prevent the steering assist mode control from being executed when the watercraft is cruising at an idling speed ranging from 0 km/h to a certain speed slightly larger than 0 km/h.

The CPU Dc repeats the above-described steering assist mode control until it judges "NO" in Step S100 or S200. When judging "NO", the CPU Dc sets back the fuel injection timing and the ignition timing of the engine E or these timings and the fuel injection amount, which were changed to increase the engine speed, to the initial drive state, i.e., the normal drive state (Step S500).

As shown in FIG. 6, the personal watercraft of this embodiment comprises a cruising speed sensor Ss for detecting the cruising speed of the watercraft, which is connected to the CPU Dc of the electric control unit Ec. The electric control unit Ec includes a control mode table Tm that prestores control modes according to the engine speeds and the cruising speeds. The CPU Dc executes the control mode selecting process in Step S300 of FIG. 7 as following the flowchart of FIG. 8.

First, the CPU Dc reads the engine speed detected by the engine speed sensor Se and the cruising speed detected by the cruising speed sensor Ss (Step S301, S302), and then refers to the control mode table Tm based on the detected engine speed and the detected cruising speed to select the corresponding control mode (Step S303).

Figure 9:
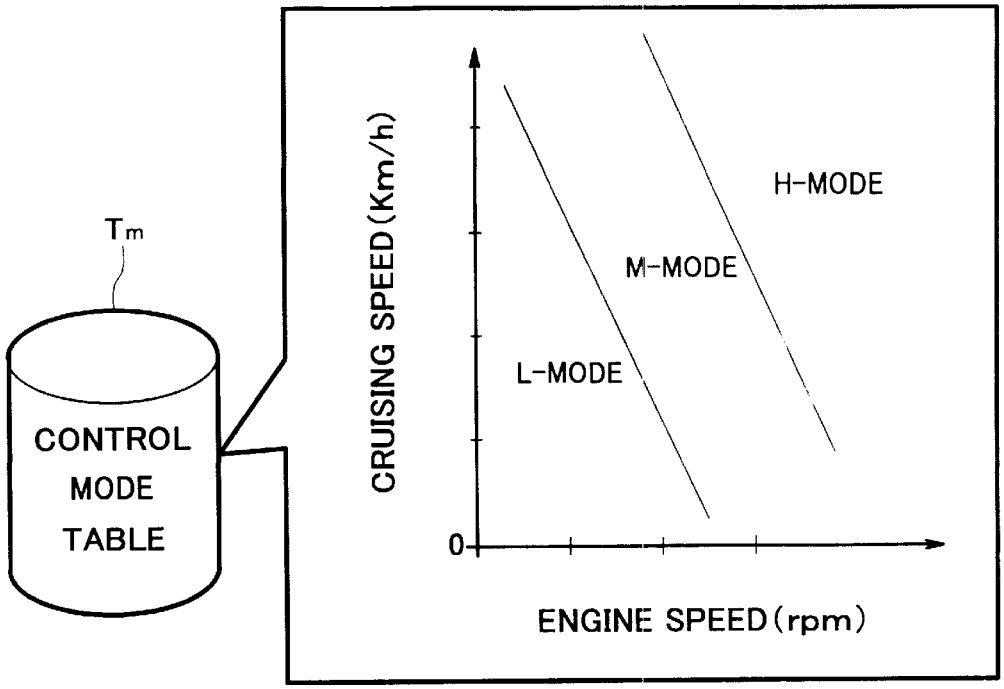
FIG. 9 is a graphic view showing contents in a control mode table of FIG. 6.

As schematically shown in the graph of FIG. 9, the control mode table Tm is adapted to define "L-mode (LOW MODE)" as the range which is less than a predetermined engine speed and less than a predetermined cruising speed, "M-mode (MODERATE MODE)" as the range of an engine speed and a cruising speed which are larger than those of the "L-mode", and "H-mode (HIGH MODE)" as the range of an engine speed and a cruising speed which are larger than those of the M-mode and to store increasing speeds of the engine speed which are decreased in the order of "L-mode", "M-mode", and "H-mode".

Figure 10:
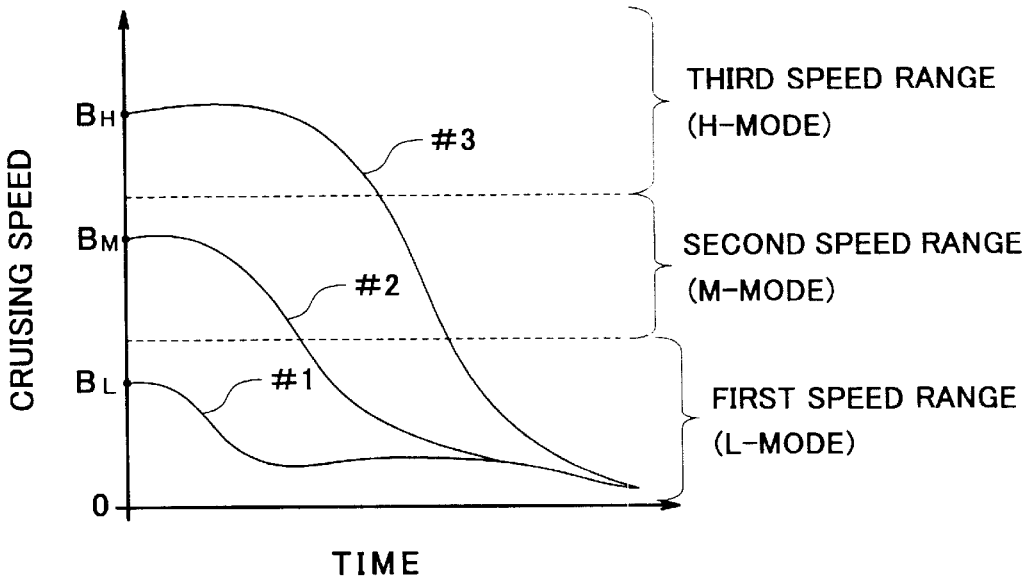
FIG. 10 is a graph showing the change in the cruising speed in each control mode of the steering assist mode control according to the embodiment.

Based on a plurality of the increasing speeds of engine speeds so defined in the control mode table Tm, the cruising speeds are smoothly decreased as shown in the graph of FIG. 10. For example, in a case where the cruising speed at a point is relatively low (represented by "BL") and the cruising speed BL is in the range (first speed range) of the L-mode, since the increasing speed of the engine speed is set to a relatively large value, the change in the cruising speed under the steering assist mode control can be subdued.

Also, in a case where the cruising speed at a point is relatively moderate (represented by "BM") and the cruising speed BM is in the range (second speed range) of the M-mode, since the increasing speed is set to a value smaller than that of the L-mode, the cruising speed is relatively slowly decreased while the engine speed is increased and, in time, reaches the region of the L-mode (first speed region). In this state, then, the increasing speed is set to a large value so that the change in the cruising speed can be further subdued (Pattern #2).

Further, in a case where the cruising speed at a point is relatively high (represented by "BH") and the cruising speed BH is in the range (third speed range) of the H-mode, since the increasing speed is set to a value smaller than that of the M-mode, the cruising speed is slowly decreased while the engine speed is increased and, in time, reaches the range of the M-mode (second speed range). In this state, then, since the increasing speed is set to a large value, the cruising speed is relatively slowly decreased while the engine speed is increased and reaches the range of the L-mode (first speed range). In this state, then, since the increasing speed is set to a larger value, the change in the cruising speed can be further subdued (Pattern #3).

Figure 11:
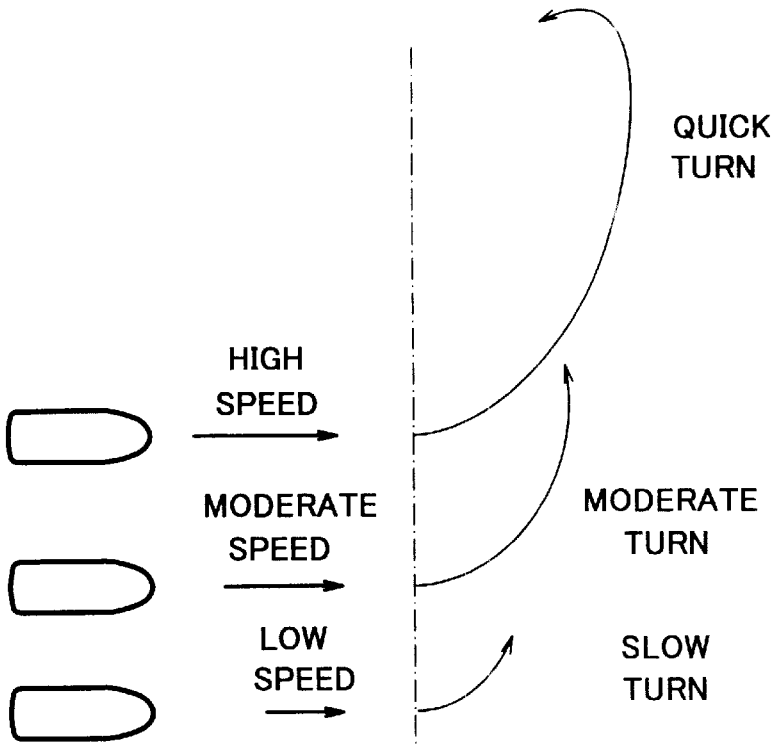
FIG. 11 is a view showing a turning state of the watercraft under the steering assist mode control according to the embodiment.

As should be appreciated, the larger the cruising speed of the watercraft is, the smaller the increasing engine speed under the steering assist mode control is set. This results in the gradual change in the cruising speed and gives the rider improved steering feeling. Specifically, as shown in FIG. 11, the personal watercraft can be turned quickly when cruising at a high speed, it can be turned moderately when cruising at a moderate speed, and it can be turned slowly when cruising at a low speed.

When determining the set values for the respective control modes stored in the control mode table Tm, i.e., the values for the cruising speeds and the values for the engine speeds defining the respective control modes, the values for the increasing speeds of the engine speeds of the respective control modes, ideal decreasing patterns (for example, Patterns #1–#3 shown in FIG. 10) of the cruising speeds are set, and the set values are determined so that the cruising speeds are decreased according to these patterns. In this embodiment, the contents stored in the control mode table Tm are represented by converting the graph of FIGS. 9, 10 into data stored in the table. Alternatively, the graph may be converted into an arithmetic expression using the engine speed and the cruising speed as parameters, and the control mode and the increasing speed may be calculated according to the arithmetic expression. In this case, the rider is given more improved steering feeling, for example, by changing the increasing speed on a continuous basis rather than switching the control mode based on the control mode table Tm on a stepwise basis.

While in the embodiment, the control mode is selected based on the cruising speed and the engine speed, it may be selected only based on the cruising speed.

The steering assist mode control of this embodiment is applied only to the forward movement of the watercraft, but may be also applied to the rearward movement. The cruising speed employed in the steering assist mode control may be obtained from the calculation with reference to the table that stores the relationship between the engine speed and the cruising speed actually measured, based on the engine speed detected by the engine speed sensor Se, as well as the direct detection by using the cruising speed sensor Ss.

Second Embodiment

As described in the first embodiment, judgment as to the change in the cruising speed of the personal watercraft before/after the steering assist mode control is made based on the cruising speed and the engine speed, and the change is subdued to an appropriate level. On the other hand, in this second embodiment, the torque of the engine E before the steering assist mode control is calculated from the engine speed, and the torque at the end of the steering assist mode control as the result of the execution of the control, i.e., a target torque, is preset. In order to subdue the change from the torque at the beginning of the control to the torque at the end of the control (i.e., target torque) to an appropriate level, the time required to reach the upper limit (for example, approximately 3000 rpm) up to which the engine speed is increased under the control is classified into two modes, a normal mode and an extended mode, as described below. Here, predetermined increasing speeds set for the extended mode are smaller than those set for the normal mode.

Figure 12:
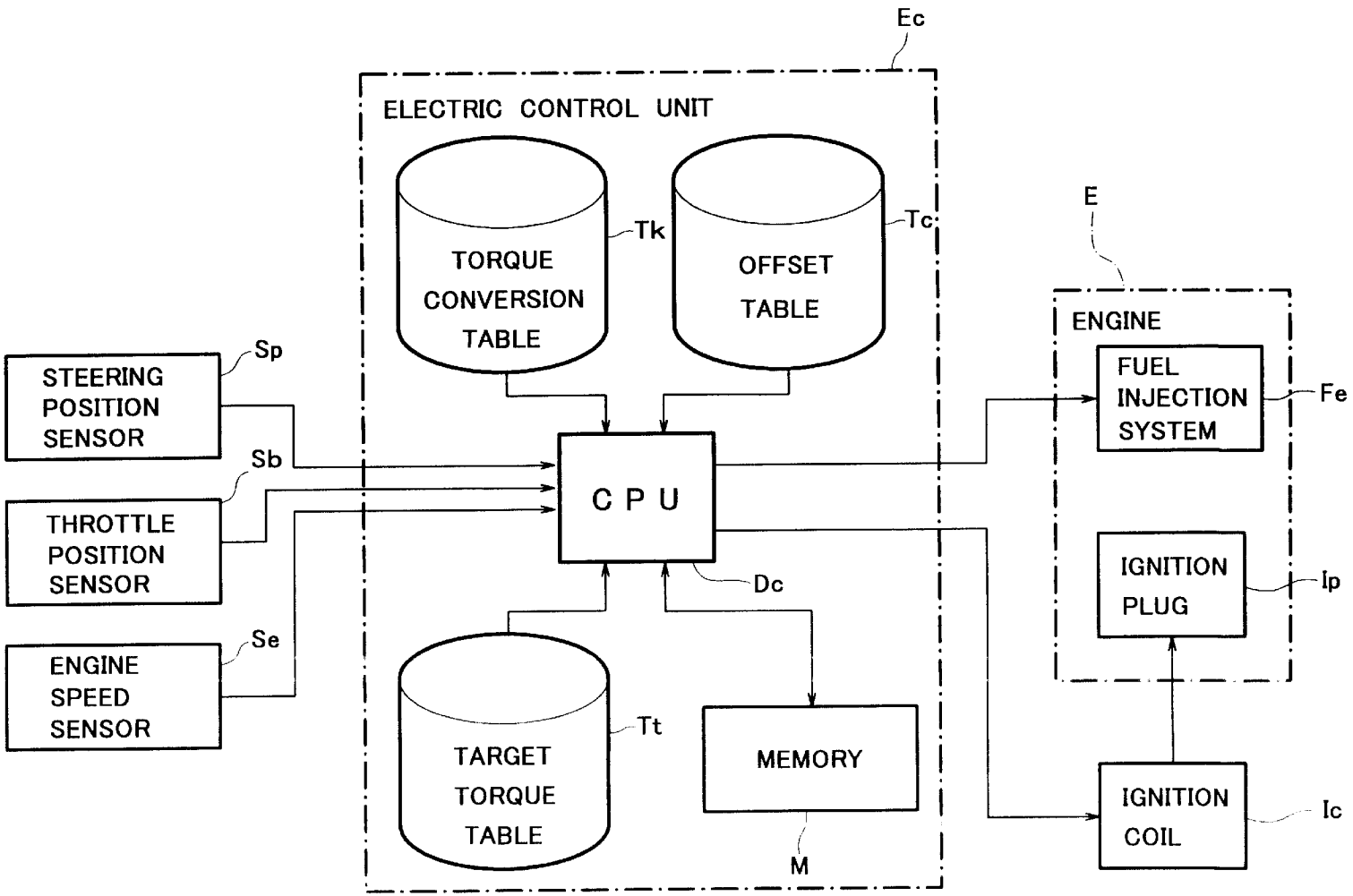
FIG. 12 is a block diagram showing a configuration of a control system of a personal watercraft according to a second embodiment of the present invention.

Specifically, as shown in FIG. 12, an electric control unit Ec of this embodiment comprises a torque conversion table Tk that prestores a torque (reference torque) of the engine E according to the engine speed instead of the control mode table Tm, an offset table Tc for offsetting the reference torque according to the change in the engine speed before the start of the control, and a target torque table Tt that prestores the target torque.

Figure 13:
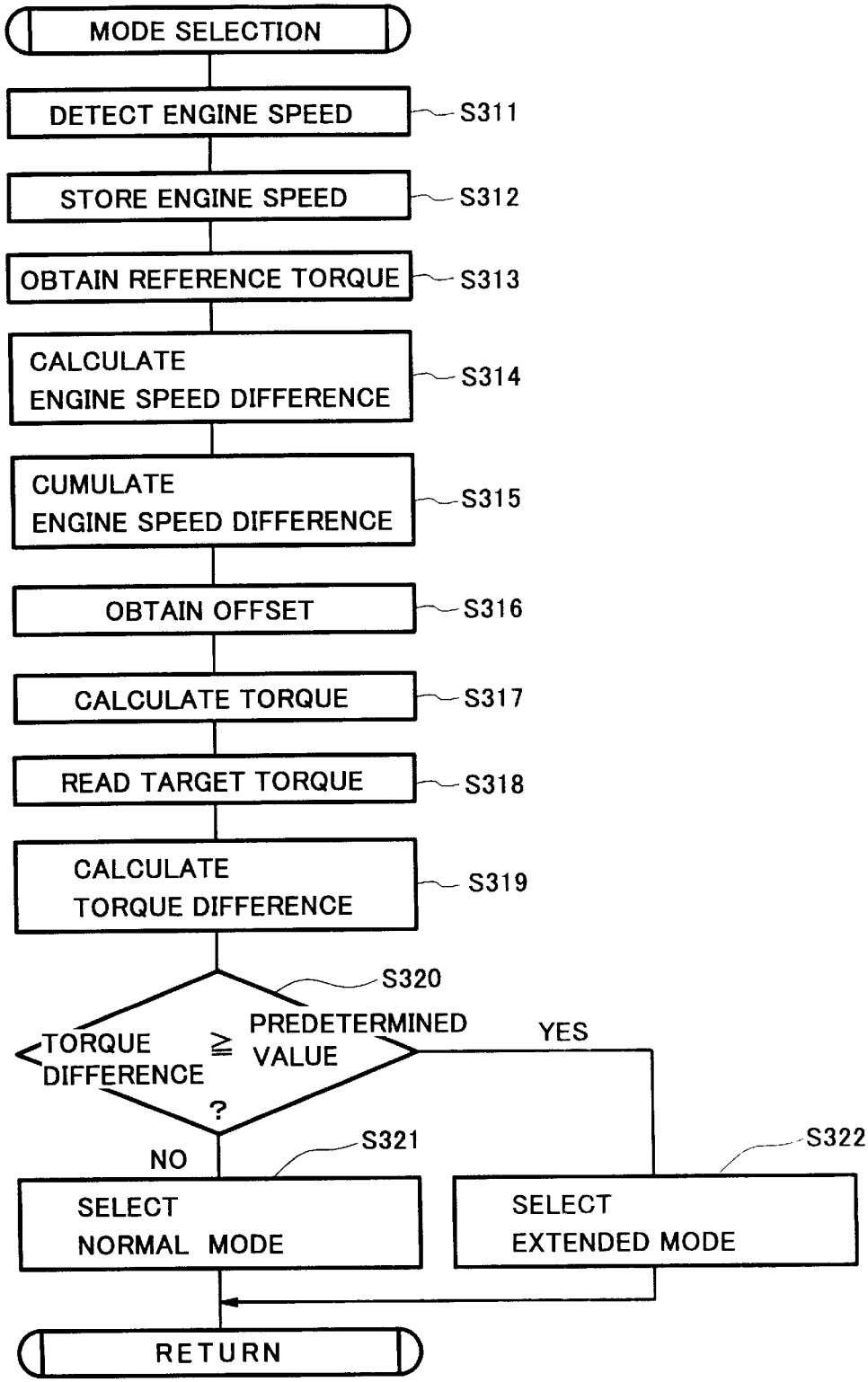
FIG. 13 is a flowchart showing a control mode selecting process according to the second embodiment.

In this embodiment, the judgment to start and end the steering assist mode control is made similar to the first embodiment of FIG. 7. Hereinafter, a mode selecting process according to this embodiment will be described with reference to FIG. 13.

First, the CPU Dc reads the engine speed detected by the engine speed sensor Se (Step S311) and sequentially stores the read engine speed in the memory M (Step S312). Then, the CPU Dc refers to the torque conversion table Tk based on the read engine speed to obtain a reference torque associated with the read engine speed (Step S313). The engine torques in so-called constant cruising state in which the delay in response of the torque with respect to the change in the engine speed is small are stored in the torque conversion table Tk as the reference torques. The reference torques are actually measured for various engine speeds in advance.

The CPU Dc calculates a difference value between the engine speed stored in the memory M at this time and the engine speed previously stored therein (Step S314), and sequentially stores the calculated difference value in the memory M. For the engine speeds stored in the memory M, the appropriate number and period of samplings are set in view of [a] the capacity of the memory M, and the calculation speed or the like of the CPU Dc.

The engine speed is sampled by the CPU Dc in every clock cycle of the CPU Dc and stored in the memory M. During this operation, the CPU Dc may control the engine speed sensor Se to detect the engine speed in every clock cycle, and may sample all of the detected engine speeds and store them in the memory M or may partially sample the detected engine speeds. Alternatively, the CPU Dc may control the engine speed sensor Se to partially detect the engine speeds.

Then, the CPU Dc cumulates difference values stored in the memory M (Step S315). The CPU Dc refers to the offset table Tc to obtain an offset value according to the engine speed detected at this time and a cumulated value of the difference values (Step S316). The CPU Dc adds the offset value to the reference value or subtracts the offset value from the reference value, based on the offset value and the reference torque obtained in Step S313 to obtain an actual torque (Step S317). To obtain the offset values according to the degree of acceleration/deceleration of the engine speeds in advance, the watercraft is actually cruised in different accelerated conditions.

In this embodiment, the actual torque is calculated based on the torque conversion table Tk and the offset table Tc. Alternatively, an arithmetic expression using the engine speed as a parameter is obtained, and the actual torque may be calculated according to the arithmetic expression.

Figure 14:
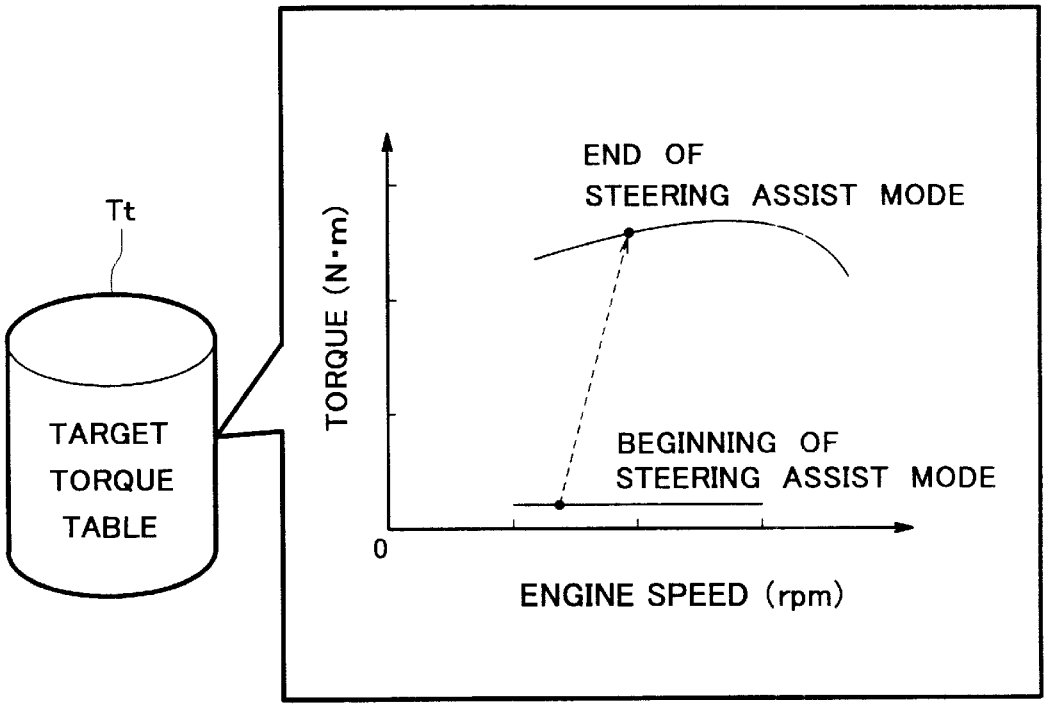
FIG. 14 is a graphic view showing contents of a target torque table of FIG. 12.

Then, the CPU Dc refers to the target torque table Tt based on the obtained actual torque and the engine speed detected at this time and reads out the corresponding target torque (Step S318). As shown in FIG. 14, the target torque table Tt stores the value for the torque obtained as the result of execution of the steering assist mode control in the case of a certain engine speed and a certain actual torque, that is, as the result of increasing the engine speed to the upper limit (for example, approximately 3000 rpm) of the control. For example, at the beginning of the control, the torque is substantially constant regardless of the engine speed and very little propulsion force is generated. Then, by the control, the torque is increased and the propulsion force is generated. At this time, the engine speed may be increased/decreased with an increase in the torque. For example, when the engine speed detected at this time is smaller than the upper limit (for example, approximately 3000 rpm), the engine speed is increased, whereas when the engine speed is larger, the engine speed is decreased. The torques are determined according to the values for the set upper limits up to which the engine speeds are increased and are stored in the target torque table Tt as the torques at the end of the steering assist mode control, i.e., the target torques, so that they are associated with the torques at the beginning of the control (actual torques), as indicated by the dashed line arrow in FIG. 14.

Then, the CPU Dc calculates a difference value between the read target torque and the actual torque (step S319), and judges whether or not the difference value is larger than a predetermined value (Step S320). When judging that the difference value is smaller than the predetermined value ("NO" in Step S320), the CPU Dc selects a normal mode (Step S321). On the other hand, when judging that the difference value is not smaller than the predetermined value ("YES" in Step S320), the CPU DC determines if the steering feeling will be affected by the change in the torque by the steering assist mode control, i.e., the change from the torque at the beginning of the control to the torque at the end of the control, is noticeable, and the watercraft is subjected to an increase in acceleration by the control. Accordingly, in this case, the CPU Dc selects the extended mode (Step S322).

Figure 15A:
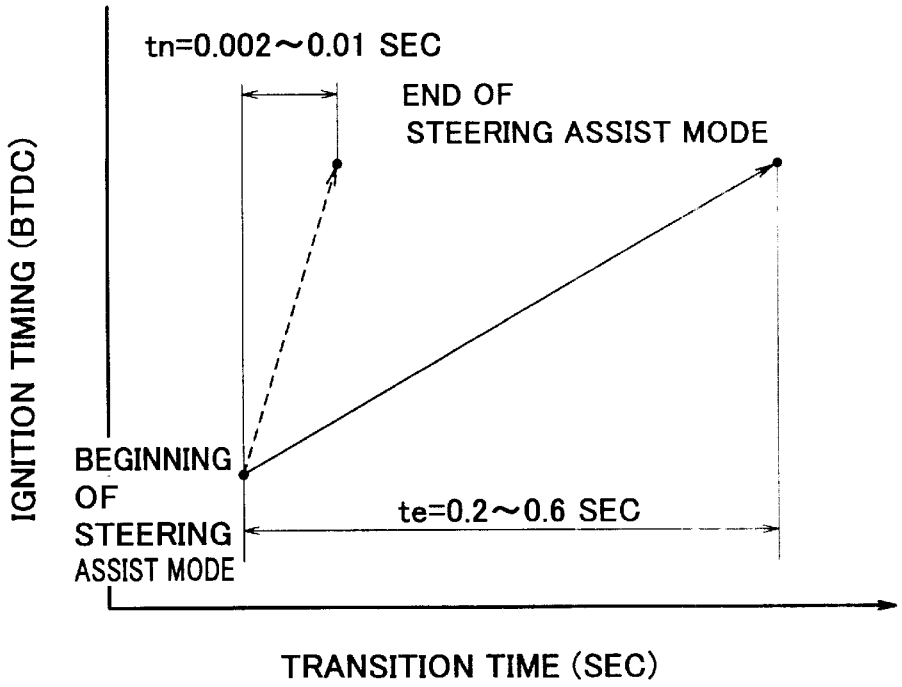
FIG. 15A is a graph showing time that takes to change an ignition timing under the steering assist mode control according to the second embodiment.
Figure 15B:
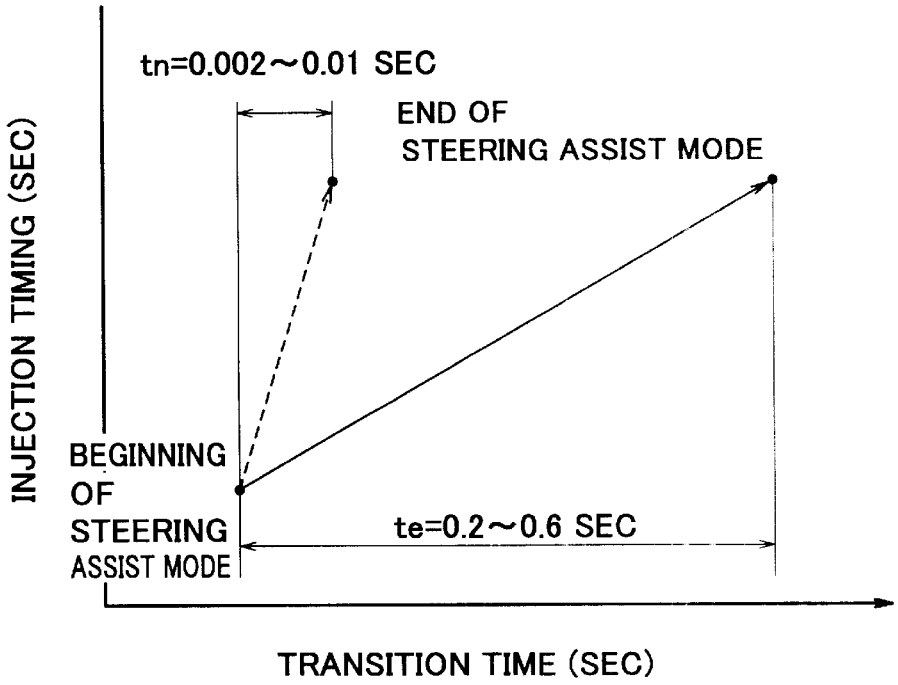
FIG. 15B is a graph showing time that takes to change an injection timing under the steering assist mode control according to the second embodiment.

Then, using the selected control mode, the steering assist mode control is started as shown in Step S400 of FIG. 7. Specifically, as shown in the dashed line arrows in FIGS. 15A and 15B, in the normal mode, the CPU Dc changes the ignition timing and the fuel injection timing of the engine E or these timings and the fuel injection amount, in order to increase the engine speed to the upper limit for a normal time tn (for example, tn=0.002–0.01 second). On the other hand, in the extended mode, as shown in a solid line arrow, the CPU Dc changes the ignition timing and the fuel injection timing of the engine E or these timings and the fuel injection amount, in order to increase the engine speed to the upper limit for an extended time te (for example, te=0.2–0.6 second).

To set the time during which the engine speed is increased longer than the time of the normal mode, the following method may be employed. As shown in FIG. 16, the ignition and/or fuel injection in each cylinder of the engine E is sequentially carried out like patterns #1–#6. In other words, "partial" combustion is conducted. In FIG. 16, ">" indicates the execution of the ignition or fuel injection and "~" indicates the non-execution of the ignition or fuel injection. Also, here, assume that the engine E has three cylinders. The patterns of the partial combustion is not limited to that of FIG. 16.

While in this embodiment, the torque of the engine E is obtained indirectly from the engine speed, it may be detected directly by a torque sensor provided on the crank shaft Cr.

While in this embodiment, two control modes, i.e., "normal mode" and "extended mode" are illustrated, a plurality of control modes having different increasing speeds of the engine speed and different extended times may be employed like the first embodiment.

This embodiment includes the above-identified configuration. Since the other function and effects of this embodiment are similar to those of the first embodiment, the corresponding parts are referenced by the same reference numerals of the first embodiment and detailed description thereof is therefore omitted.

Third Embodiment

In the second embodiment, the judgment as to the change in the cruising speed of the personal watercraft before/after the steering assist mode control is indirectly made based on the torque of the engine E and the change is subdued to the appropriate level. On the other hand, in this third embodiment, the judgment as to the change in the cruising speed before/after the steering assist mode control is directly made based on the cruising speed and the change is subdued to the appropriate level.

Figure 17:
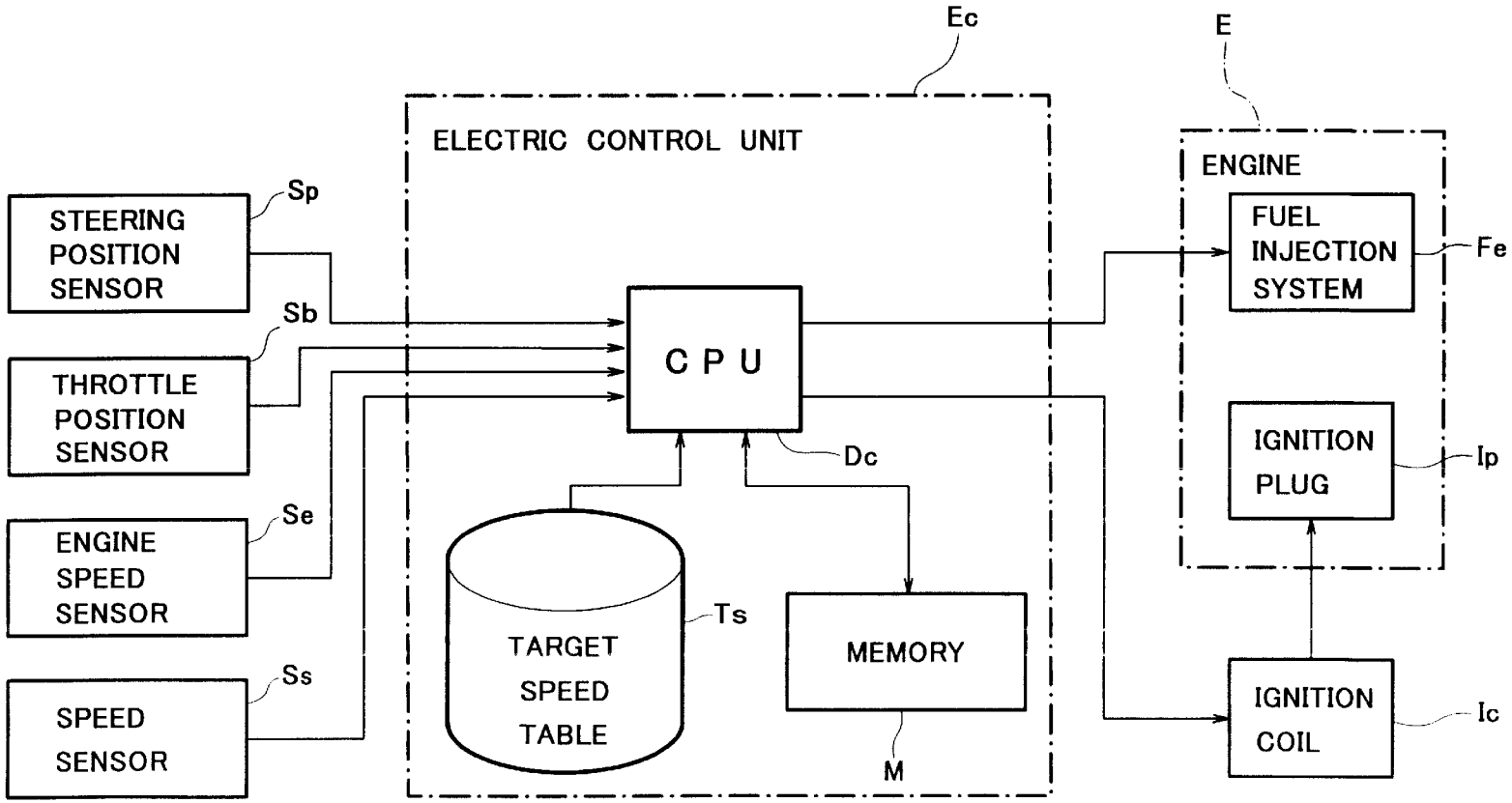
FIG. 17 is a block diagram showing a configuration of a control system of a personal watercraft according to a third embodiment of the present invention.

Specifically, as shown in FIG. 17, the electric control unit Ec of this embodiment includes a target speed table Ts for prestoring target cruising speeds and a memory M. The personal watercraft of this embodiment is provided with a speed sensor Ss connected to the electric control unit Ec, for detecting the cruising speed of the watercraft.

Figure 18:
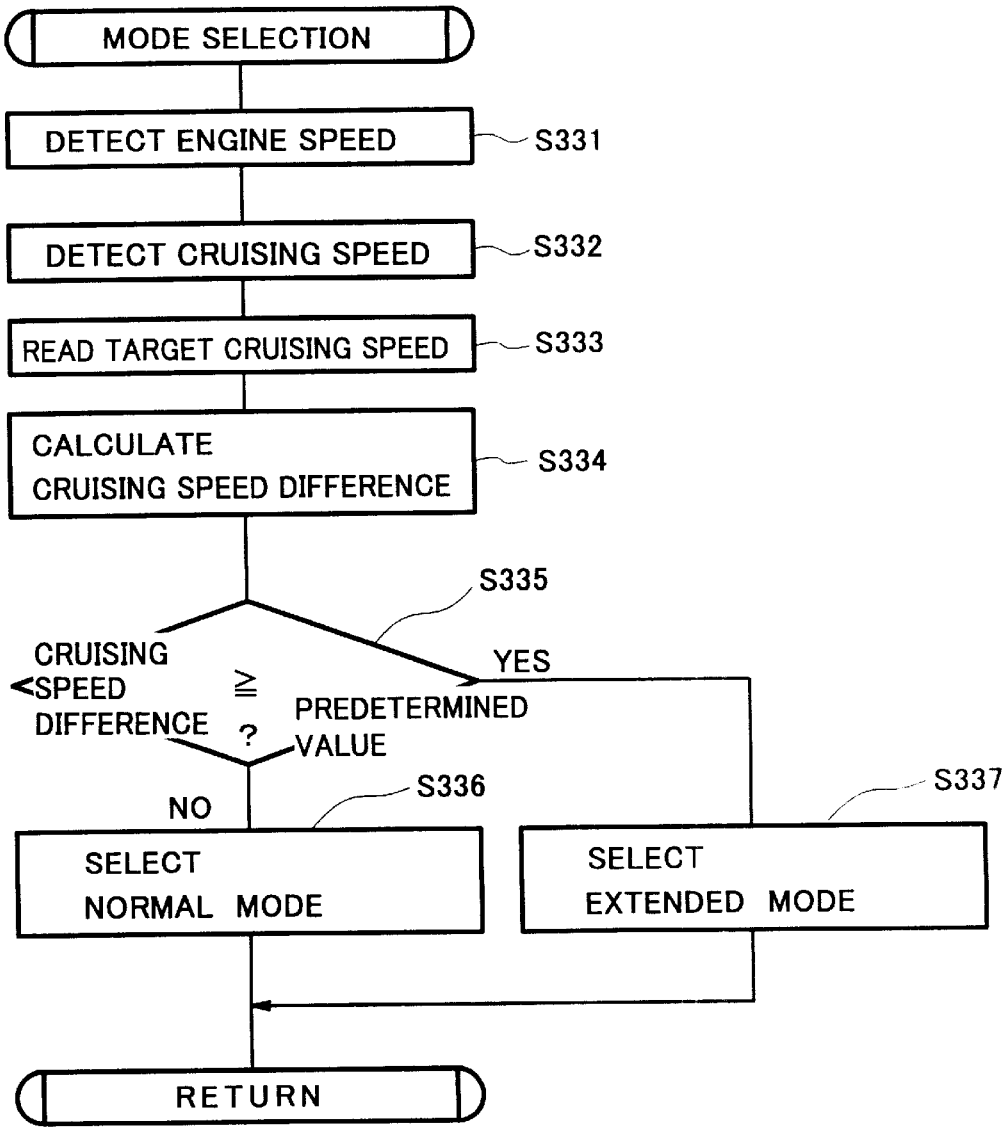
FIG. 18 is a flowchart showing a control mode selecting process according to the embodiment of FIG. 17.

In this embodiment, the judgment as to the start of the steering assist mode control and the end of the control is made in the same way as the first embodiment. Hereinbelow, a mode selecting process according to this embodiment will be described with reference to FIG. 18.

Figure 19:
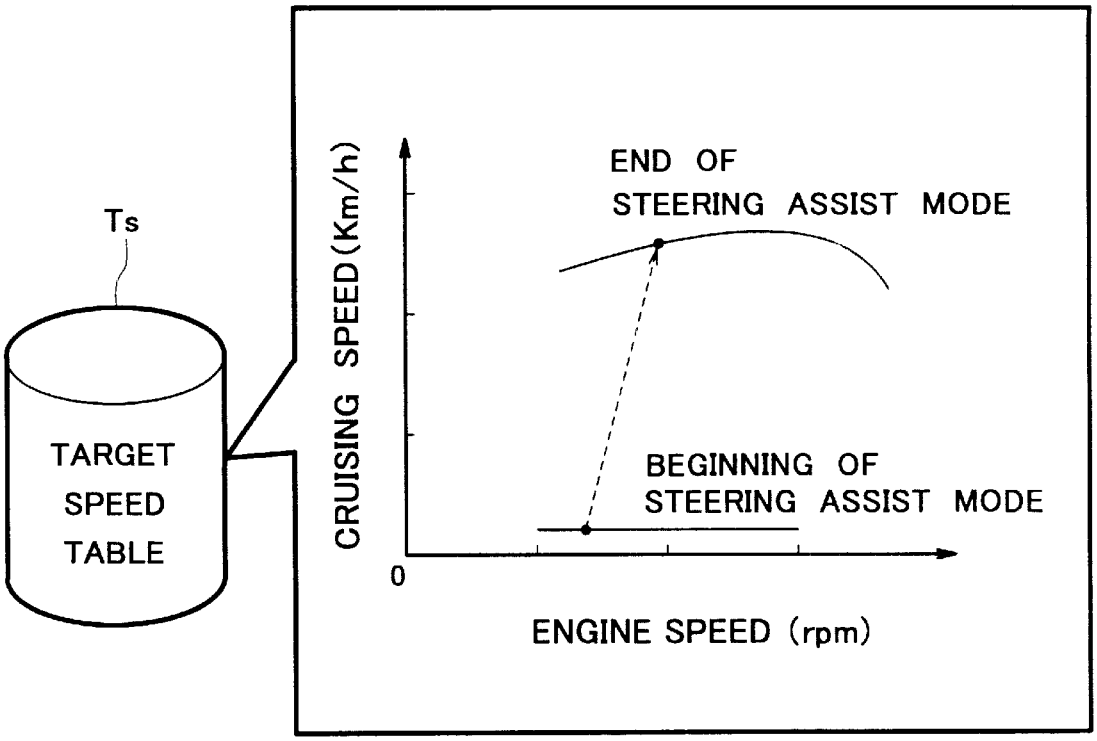
FIG. 19 is a graphic view showing contents of a target cruising speed table of FIG. 17.

First, the CPU Dc reads the engine speed detected by the engine speed sensor Se and the cruising speed detected by the speed sensor Ss (Step S331, S332) and refers to the target speed table Ts based on the detected cruising speed (actual cruising speed) and the lastly detected engine speed to read out the corresponding target cruising speed (Step S333). As shown in FIG. 19, the target speed table Ts stores the values for the cruising speeds obtained as the result of execution of the steering assist mode control in the case of a certain engine speed and a certain actual cruising speed, that is, as the result of increasing the engine speed to the upper limit (for example, approximately 3000 rpm) of the control. For example, at the beginning of the control, the cruising speed is substantially constant regardless of the engine speed and very little propulsion force is generated. Then, by the control, the propulsion force is generated and the cruising speed is increased. At this time, the engine speed may be increased/decreased with an increase in the cruising speed. For example, when the last-detected engine speed is smaller than the upper limit (for example, approximately 3000 rpm), the engine speed is increased, whereas when the engine speed is larger, the engine speed is decreased. The cruising speeds are determined according to the values for the set upper limits of the engine speeds and are stored in the target speed table Ts as the cruising speeds at the end of the steering assist mode, i.e., the target cruising speeds, so that they are associated with the cruising speeds at the beginning of the control (actual cruising speeds), as show in the dashed line arrow of FIG. 19.

Then, the CPU Dc calculates a difference value between the read target cruising speed and the actual cruising speed (step S334), and judges whether or not the difference value is larger than a predetermined value (Step S334). When judging that the difference value is smaller than the predetermined value ("NO" in Step S335), the CPU Dc selects the normal mode (Step S336). On the other hand, when judging that the difference value is larger than the predetermined value ("YES" in Step S335), the CPU DC determines if the steering feeling will be affected by the change in the cruising speed by the steering assist mode control, i.e., the change from the cruising speed at the beginning of the control to the cruising speed at the end of the control, is noticeable, and the watercraft is subjected to an increase in acceleration by the control. Accordingly, in this case, the CPU Dc selects the extended mode (Step S337). Then, using the selected control mode, the steering assist mode control is started as similar to the second embodiment.

While in this embodiment, the cruising speed is directly detected by the cruising sensor Ss, it may be indirectly obtained from the engine speed, for example.

This embodiment includes the above-described configuration. Since the other functions and effects are similar to those of the second embodiment, the corresponding parts of this embodiment are referenced by the same reference numerals and the detailed description thereof is therefore omitted.

Fourth Embodiment

In each of the above embodiments, when the cruising speed is equal to the idling speed, it is desirable that the steering assist mode control is not executed, and the judgment as to whether or not the cruising speed is equal to the idling speed is directly made based on the cruising speed or indirectly made using the torque or the like in substitution for the cruising speed. In this fourth embodiment, the judgment is made based on the engine speed in substitution for the cruising speed. It should be noted that an average value of the engine speed (average engine speed) is obtained from a history of the engine speed because there is no direct relation between the cruising speed and the engine speed, and the judgment is made based on the average engine speed. Accordingly, the configuration of this embodiment may be suitably combined into each of the above embodiments or can be employed independently.

Figure 20:
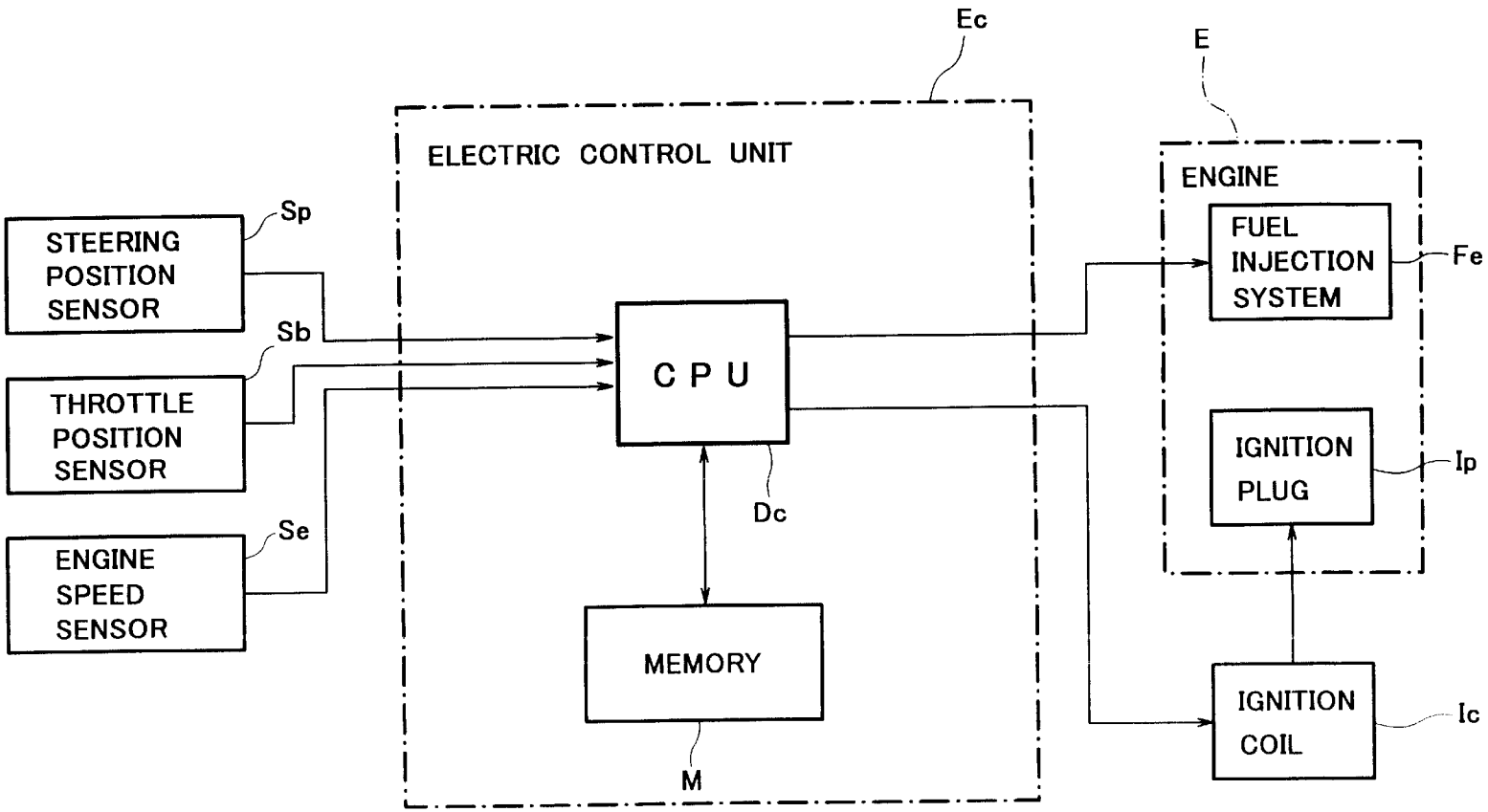
FIG. 20 is a block diagram showing a configuration of a control system of a personal watercraft according to a fourth embodiment of the present invention.
Figure 21:
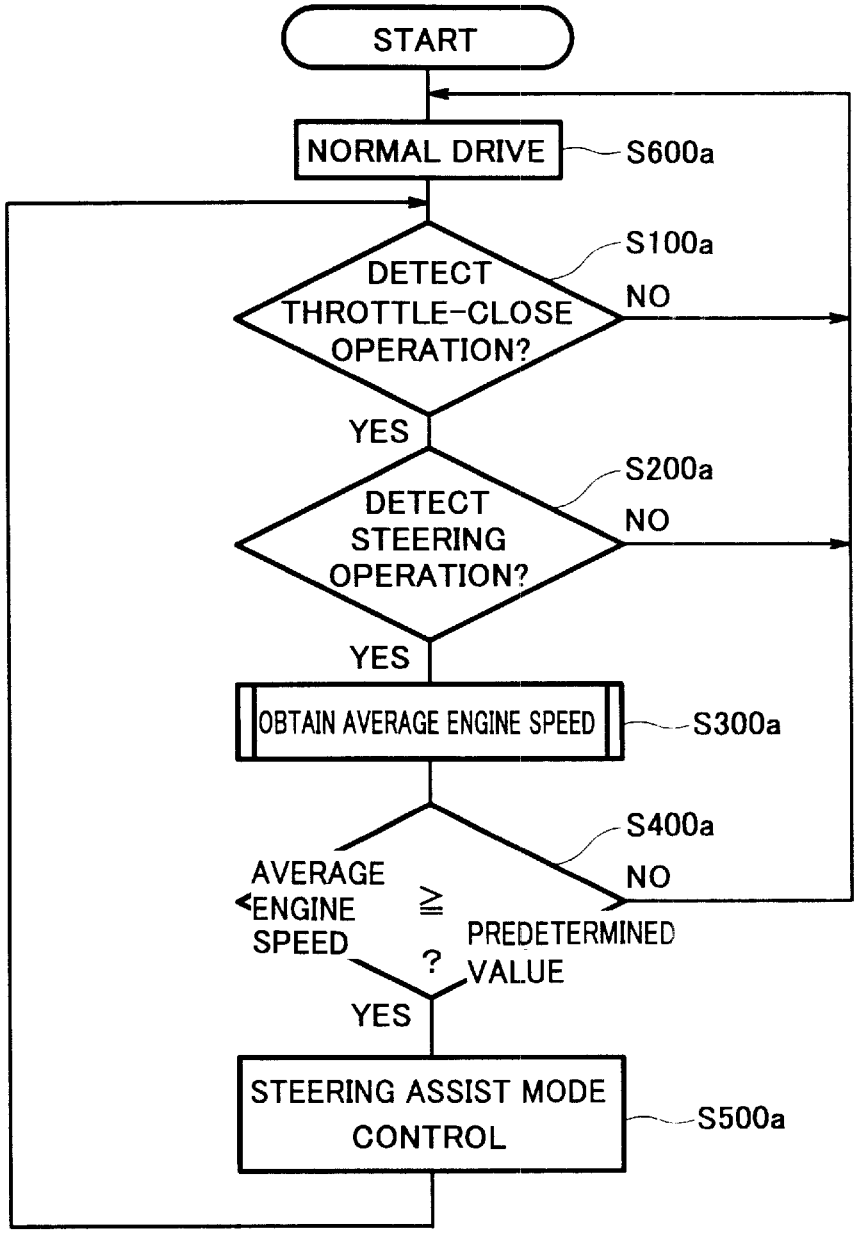
FIG. 21 is a flowchart showing a control process under the steering assist mode control according to the embodiment of FIG. 20.

As shown in the hardware configuration of FIG. 20, the personal watercraft of this embodiment comprises a steering position sensor Sp, a throttle position sensor Sb, and an engine speed sensor Se as a detecting system. The electric control unit Ec includes the CPU Dc and the memory M, and is adapted to judge whether or not to execute the steering assist mode control following the flowchart of FIG. 21.

During the cruising of the personal watercraft, the CPU Dc first judges whether or not the throttle position sensor Sb has detected that the rider performed the throttle-close operation (Step S100*a*).

When judging that the throttle-close operation has been detected ("YES" in Step S100*a*), the CPU Dc judges whether or not the steering position sensor Sp has detected that the rider rotated the steering handle 10 by the predetermined angle to the right or to the left (Step S200*a*).

When judging that the steering operation has been detected ("YES" in Step S200*a*), the CPU Dc calculates the average engine speed as described below (Step S300*a*), and judges whether or not the calculated average engine speed is larger than a predetermined value (for example, approximately 2000 rpm–3000 rpm) (Step S400*a*).

On the other hand, when judging that the throttle-close operation has not been detected ("NO" in Step S100*a*), or the steering operation has not been detected ("NO" in Step S200*a*), the CPU Dc maintains a current drive state, i.e., a normal drive state (Step S600*a*).

When judging that the average engine speed is larger than the predetermined value ("YES" in Step S400*a*), the CPU Dc judges that the cruising speed of the personal watercraft is larger than the predetermined value and starts executing the steering assist mode control (Step S500*a*) to change the fuel injection timing and the ignition timing of the engine E, or these timings and the fuel injection amount, thereby increasing the engine speed. Then, the CPU Dc repeats Step S100*a*–S500*a* until it judges "NO" in Step S100*a,* S200*a,* or S400*a*. When judging "NO", the CPU Dc sets back the fuel injection timing and the ignition timing of the engine E or these timings and the fuel injection amount, which were changed to increase the engine speed, to the initial drive state, i.e., the normal drive state (Step S600*a*).

Figure 22:
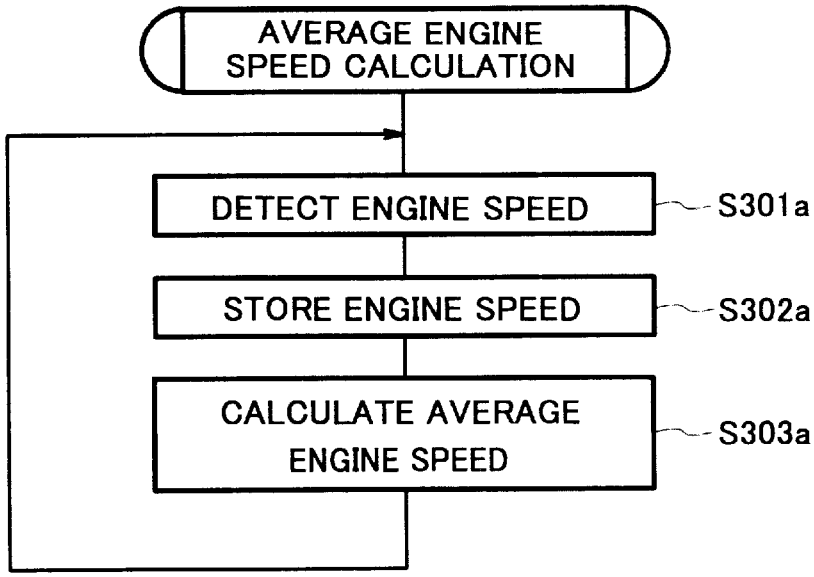
FIG. 22 is a flowchart showing a calculation process of an average engine speed in FIG. 21.

Subsequently, the calculation process of the average engine speed in the Step S300*a* will be described in detail with reference to the flowchart of FIG. 22. First, the CPU Dc reads the engine speed detected by the engine speed sensor Se (Step S301*a*), and sequentially stores the detected engine speed in the memory M (Step S302*a*). For the engine speeds stored in the memory M, the appropriate number and period of samplings (for example, 10 seconds) are set in view of the capacity of the memory M, and the calculation speed or the like of the CPU Dc.

Here, assume that a first period is for a predetermined time period back from the last detection of the throttle close operation and the steering operation and a second period is a period just before the first period. The CPU DC reads out the engine speeds in the second period stored in the memory M and calculates the average value of these engine speeds, i.e., the average engine speed (Step S303*a*).

Figure 23A:
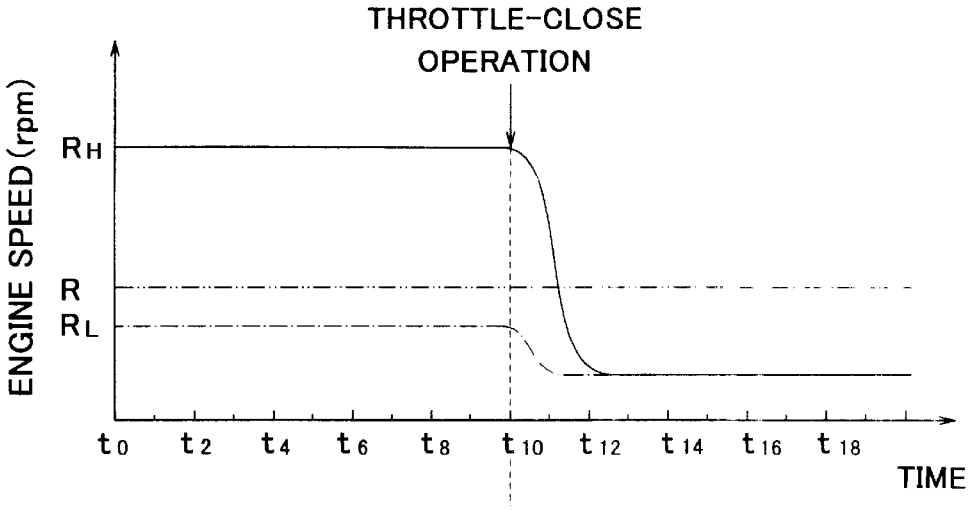
FIG. 23A is a graph showing time-series change of the engine speed occurring when the throttle-close operation is performed in the constant cruising state at a high or low speed.

Hereinbelow, how the engine speeds stored in the second period are adopted will be explained in detail. FIG. 23A is a graph showing the time-series change in the engine speed associated with the throttle-close operation. The graph shows the case where the watercraft is cruising at a high engine speed RH (represented by a solid line in FIG. 23A) and a low engine speed RL (represented by a dashed line in FIG. 23A) and the throttle-close operation is performed at t10.

Figure 23B:
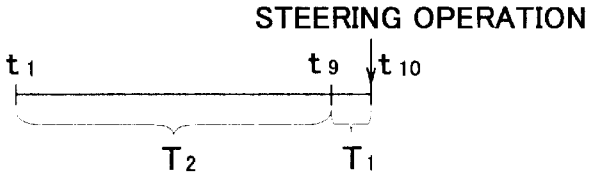
FIGS. 23B–23D are views each showing a temporal range of the engine speed adopted in the steering assist mode control according to the timing of the steering operation at or after the throttle-close operation.
Figure 23C:
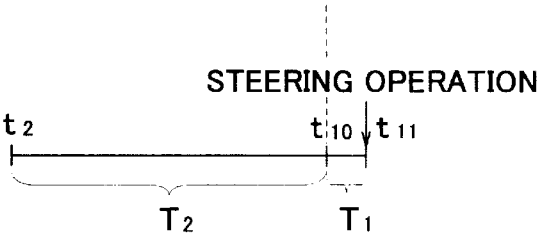

When the throttle-close operation and the steering operation are performed substantially at the same time as shown in FIG. 23B, the CPU Dc does not adopt the engine speeds in the first period T1 from the time t10 when the steering operation was detected to the time t9 before a given period from t10 but adopts the engine speeds detected in the second period T2 (t1–t9 in FIG. 23B ) and calculates an average value of these engine speeds.

Figure 24A:
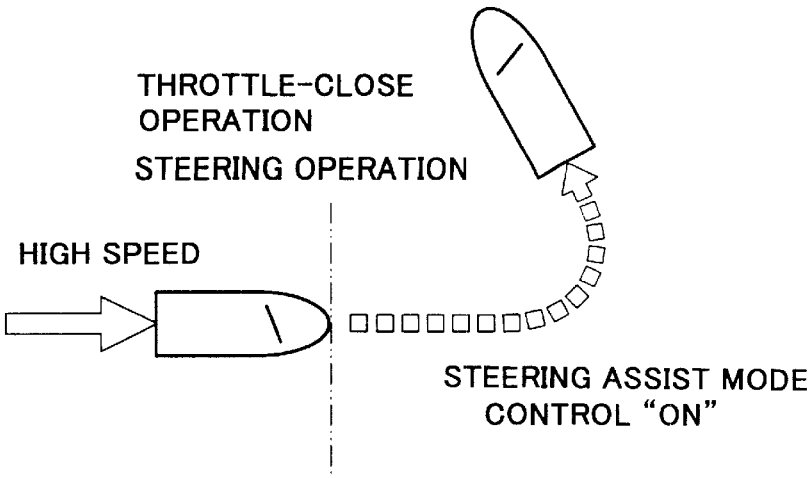
Figure 24B:
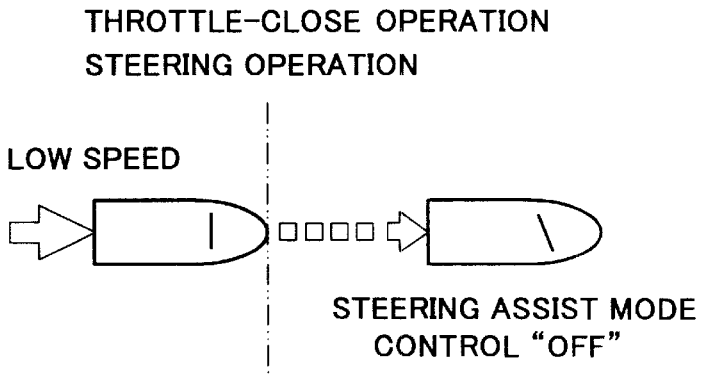
Figure 24C:
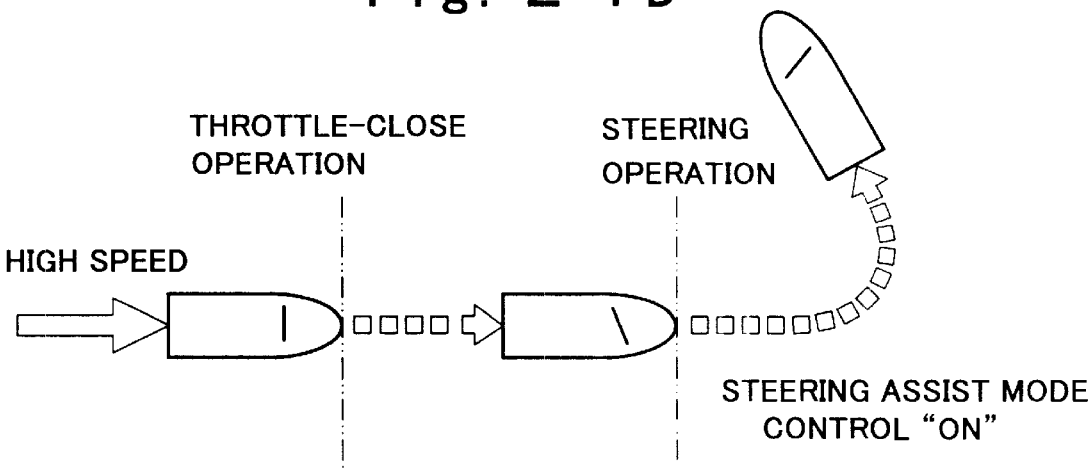

While the first period T1 and the second period T2 may be suitably set according to the actual characteristic and usage of the watercraft as shown in FIGS. 24A–24C described later, it is preferable that the first period T1 is almost equal to the period during which the engine speed decreased in a very short time as the result of the throttle-close operation reaches the idling speed, and the second period T2 is set considerably longer than the period from the point of the assumed throttle-close operation to the steering operation thereafter, depending on the set period T1. By way of example, it is preferable that the first period T1 is approximately 0.5 second and the second period T2 is approximately 3–5 seconds.

By assuming that the predetermined engine speed in Step S400*a* is "R" and setting the predetermined engine speed "R" to the value between the high engine speed RH and the low engine speed RL, the steering assist mode control can be executed only when the average engine speed of the second period T2 is larger than the predetermined engine speed R. It should be noted that the predetermined engine speed R is preferably set to the engine speed slightly larger than the low engine speed RL.

The average engine speed may be replaced by another statistical values. Also in this case, it is essential that the engine speeds only in the second period T2 just before the first period T1 be employed in the judgment as to the start and end (ON/OFF) of the steering assist mode control.

Subsequently, an ON/OFF operation of the steering assist mode control according to the actual cruising and steering of the personal watercraft of this embodiment will be explained.

For example, as shown in FIG. 24A, when the steering operation is performed at the same time or within a very short time period after the throttle-close operation when the watercraft is cruising at a high speed (e.g. 50 mile/hr or approximately 80 km/hr), the engine speeds in the second period T2 (t1–t9) except the first period T1 (t9–t10) are adopted (see FIG. 23B). Since the adopted engine speeds are those in the constant cruising at 50 mile/hr (or approximately 80 km/hr), and the values thereof are considerably larger than the predetermined engine speed R (see FIG. 23A), the steering assist mode control is "ON" and under the control, the steering capability is maintained after the throttle-close operation. Consequently, as shown in FIG. 24A, the watercraft is smoothly turned.

As shown in FIG. 24B, when the throttle-close operation is performed when the watercraft is cruising at a low cruising speed (e.g. 5 mile/hr or approximately 8 km/hr), for example, when the watercraft is getting to the shore, and the steering operation is performed substantially at the same time, the engine speeds in the second period T2 (t1–t9) except the first period T1 (t9–t10) are adopted (see FIG.

23B). Since the adopted engine speeds are those in the constant cruising at 5 mile/hr (or approximately 8 km/hr), and the values thereof are smaller than the predetermined engine speed R, the steering assist mode control is "OFF" and the watercraft can smoothly get to the shore without the control.

As shown in FIG. 24C, assume that the steering operation is performed after the watercraft is moved by inertia for a certain time due to the delay in the steering operation after the throttle-close operation in the high-speed cruising state. When the delay time of the steering operation is equal to very little time included in the time period (substantially corresponding to t10–t12 of FIG. 23A and about 0.5 second in the case of the personal watercraft of this embodiment) during which the engine speed is decreased to the idling speed, that is, if the steering operation is performed at t11, t10–t11 becomes the first period T1, and the engine speeds in the first period T1 are not adopted but instead, only the engine speeds in the constant cruising state during the time period T2 (t2–t10) before the first period T1 are adopted. Since the engine speeds are larger than the predetermined engine speed R, the steering assist mode control is "ON" and under this control, the steering capability is maintained, thereby allowing the watercraft to be smoothly turned as desired by the rider, as shown in FIG. 24C.

Figure 23D:
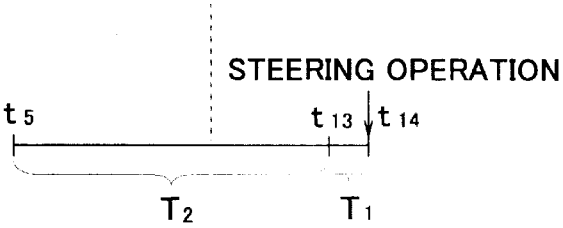

Assuming that the delay of the steering operation is longer than that described above and the steering operation is performed at t14 as shown in FIG. 23D, the average engine speed includes the engine speeds in the time period t10–t12 during which the engine speed is decreased to the idling speed. However, since t5–t10 in the constant cruising state occupies the most part of the second period T2 (t5–t13), the average engine speed becomes larger than the predetermined engine speed R, and the steering assist mode control is "ON", thereby allowing the watercraft to be smoothly turned.

This embodiment includes the above-identified configuration. Since the other functions and effects are similar to those of the first embodiment, the corresponding parts of this embodiment are referenced by the same reference numerals and the detailed description thereof is therefore omitted.

Fifth Embodiment

The steering characteristic of the each of the above embodiments can be obtained by simply delaying the timing of the start of the steering assist mode control after the detection of the throttle-close operation and the steering operation. Specifically, the engine speed is rapidly decreased after the throttle-close operation, and the propulsion force of the water pump P is correspondingly decreased. Since the timing of the control is delayed, the cruising speed is decreased to some degree by the start of the control, and thereby, the change between the cruising speed at the beginning of the control and the cruising speed at the end of the control can be lessened.

Figure 25:
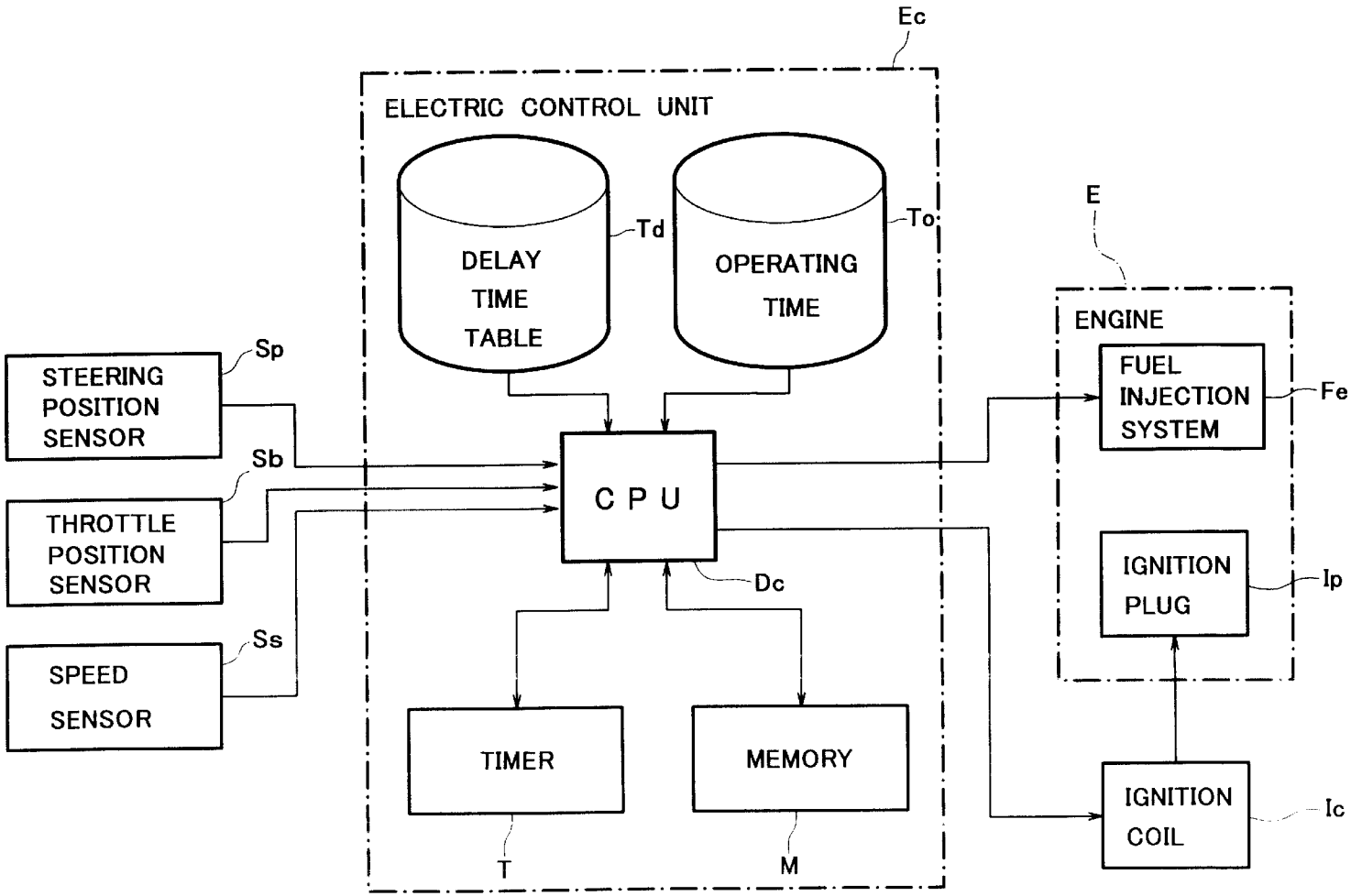
FIG. 25 is a block diagram showing a configuration of a control process of a personal watercraft according to a fifth embodiment of the present invention.
Figure 26:
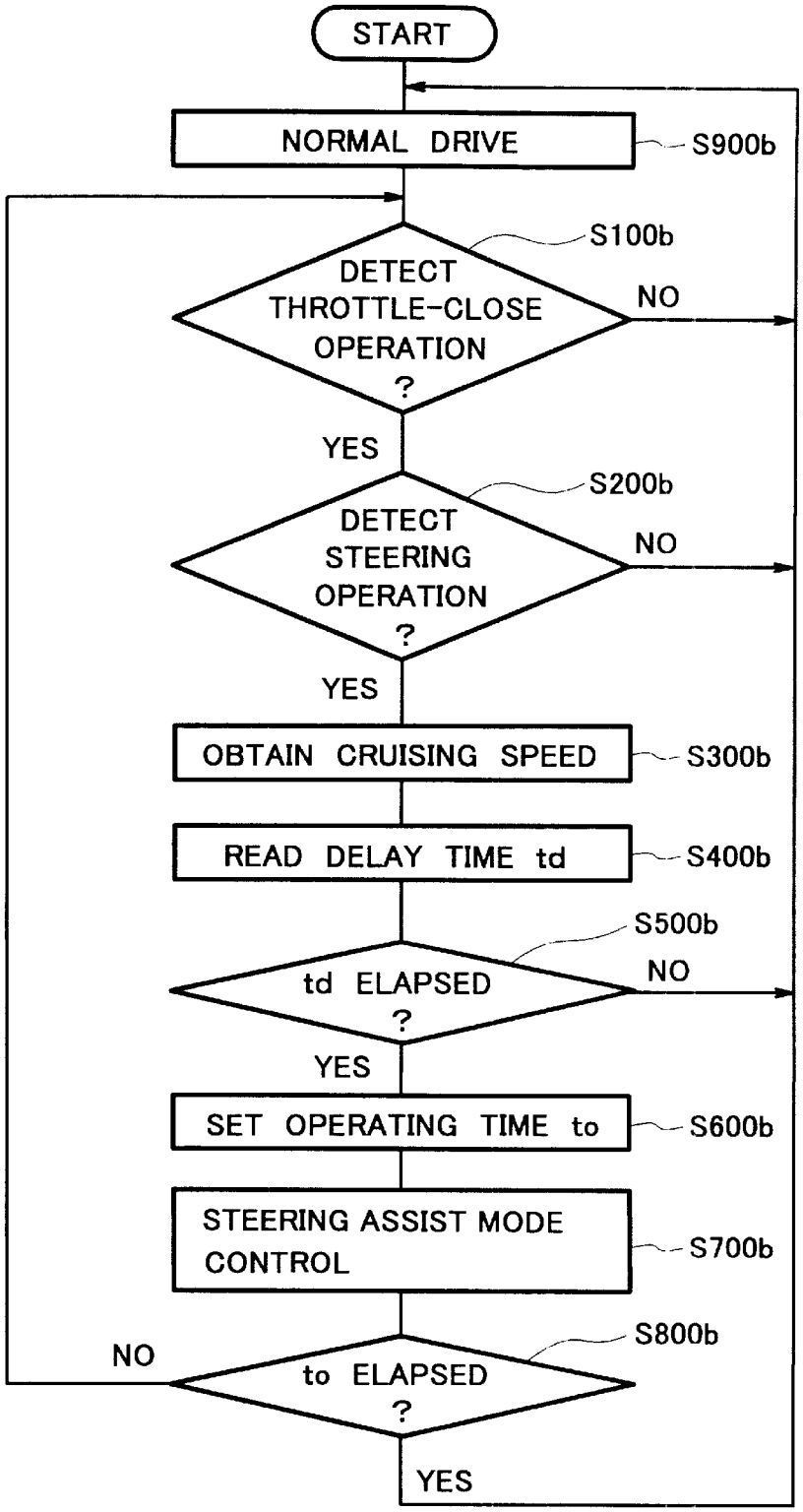
FIG. 26 is a flowchart showing a control process performed under the steering assist mode control according to the embodiment of FIG. 25.

As shown in the hardware configuration of FIG. 25, the personal watercraft of this fifth embodiment comprises the steering position sensor Sp, the throttle position sensor Sb, and the speed sensor Ss as a detecting system. The electric control unit Ec comprises the CPU Dc, the memory M, a delay time table Td, an operating time table To, and a timer T, and is adapted to delay the timing of the start of the steering assist mode control according to the cruising speed following a flowchart of FIG. 26. In addition to the delay of the start timing, in this embodiment, the time period during which the engine speed is increased under the control is set longer according to the cruising speed.

When the personal watercraft is cruising, first of all, the CPU Dc judges whether or not the throttle position sensor Sb has detected that the rider performed the throttle-close operation (Step S100*b*).

When judging that the throttle-close operation has been detected ("YES" in Step S100*b*), the CPU Dc judges whether or not the steering position sensor Sp has detected that the rider rotated the steering handle 10 by the predetermined angle to the right or to the left (Step S200*b*).

When judging that the steering operation has been detected ("YES" in Step S200*b*), the CPU Dc reads the cruising speed detected by the speed sensor Ss (Step S300*b*). The cruising speed may be indirectly obtained by [the] a calculation from the engine speed.

Figure 27:
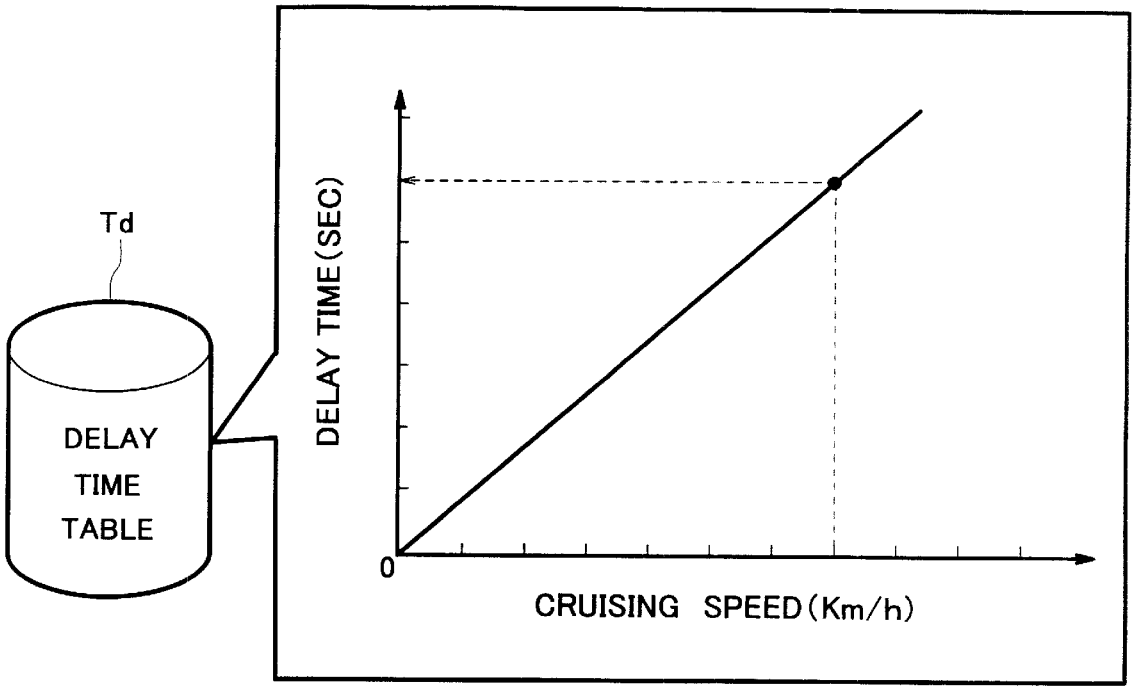
FIG. 27 is a graphic view showing contents of a delay time table of FIG. 25.

The CPU Dc refers to the delay time table Td of FIG. 27 based on the read cruising speed to obtain the corresponding delay time td (Step S400*b*). In this embodiment, as shown in FIG. 27, the delay time td is set to be directly proportional to the cruising speed, but this relationship is only illustrative. The CPU Dc controls the timer T to start counting of the obtained delay time td and judges whether or not the delay time td has elapsed (Step S500*b*).

When the throttle-close operation has not been detected ("NO" in Step S100*b*), the steering operation has not been detected ("NO" in Step S200*b*), or the delay time td has not elapsed ("NO" in Step S500*b*), the CPU Dc maintains a current drive state, i.e., a normal drive state (Step S900*b*).

Figure 28:
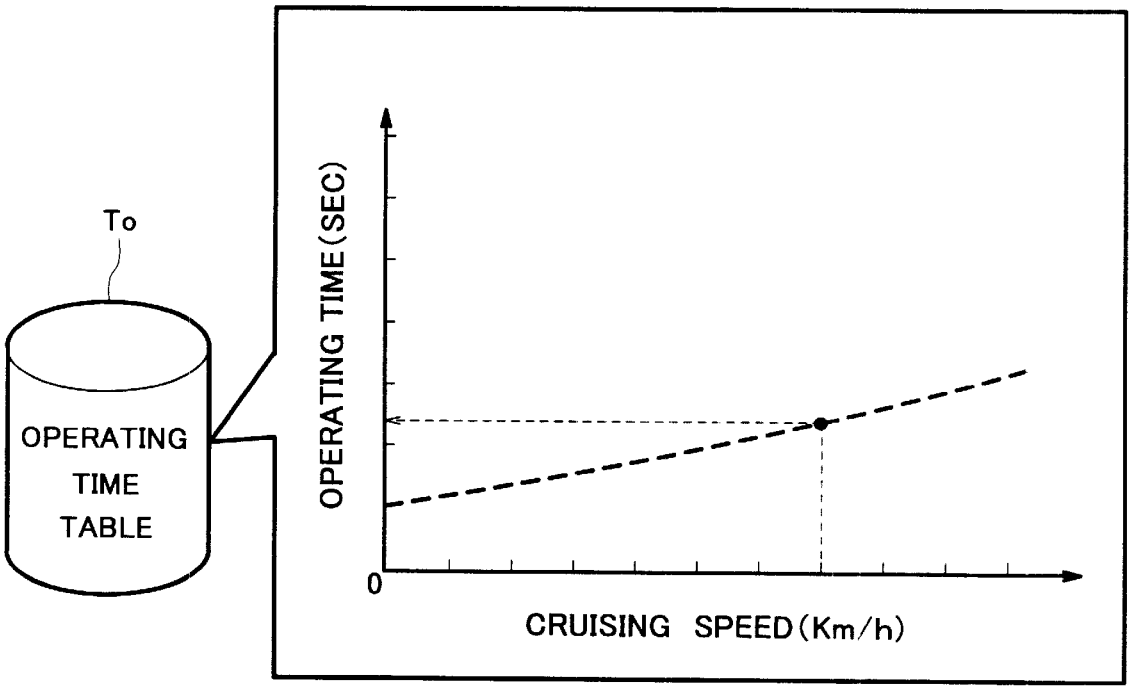
FIG. 28 is a graphic view showing contents of an operating time table of FIG. 25.

On the other hand, when judging that the delay time td has elapsed ("YES" in Step S500*b*), the CPU Dc refers to the operating time table To of FIG. 28 based on the cruising speed to obtain the corresponding operating time to and sets this operating time for starting the steering assist mode control (Step S600*b*). At this time, the CPU DC controls the timer T to start counting of the set operating time to. In this embodiment, the operating time to is set to be directly proportional to the cruising speed, but this relationship is only illustrative.

The DCU Dc starts executing the steering assist mode control (Step S700*b*) to change the fuel injection timing and the ignition timing of the engine E, or these timings and the fuel injection amount, thereby increasing the engine speed. Then, the CPU Dc judges whether or not the operating time to has elapsed (Step S800*b*), and when judging that the operating time to has elapsed ("YES" in Step S800*b*), the CPU Dc sets back the fuel injection timing and the ignition timing of the engine E or these timings and the fuel injection amount, which were changed to increase the engine speed, to the initial drive state, i.e., the normal drive state (Step S900*b*). On the other hand, when judging that the operating time to has not elapsed ("NO" in Step S800*b*), the CPU Dc repeats Steps S100*b*–S800*b* until it judges "NO" in Step S100*b*, S200*b*, or S500*b*.

Figure 29:
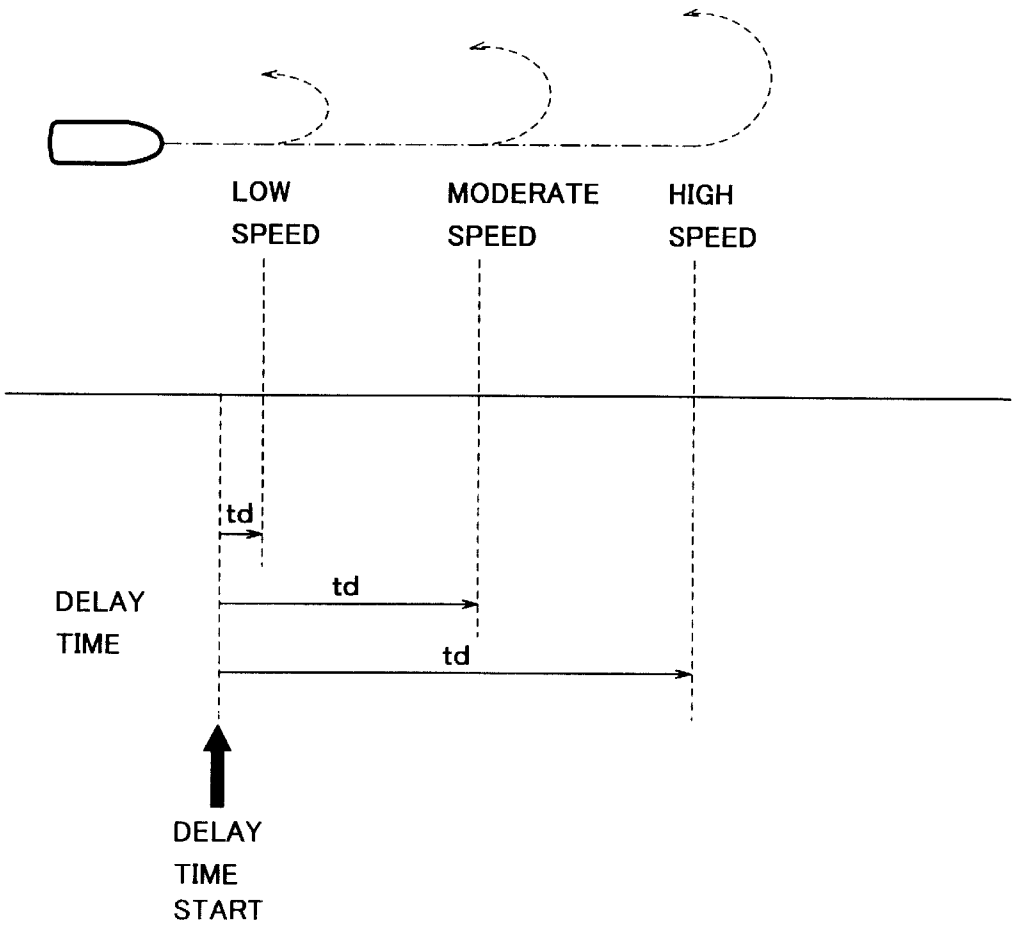
FIG. 29 is a view showing a turning state of the watercraft under the steering assist mode control according to the embodiment of FIG. 25.

In the personal watercraft of this embodiment, according to the above-described procedure, the larger the cruising speed at the beginning of the control is, the longer the delay time td is set as shown in FIG. 29. Consequently, a turning response to the steering operation is improved.

The personal watercraft of this embodiment includes the above-identified configuration. Since the other functions and effects thereof are similar to those of the other embodiments, the corresponding parts of this embodiment are referenced to by the same numerals and will not be described in detail.

Figure 30:
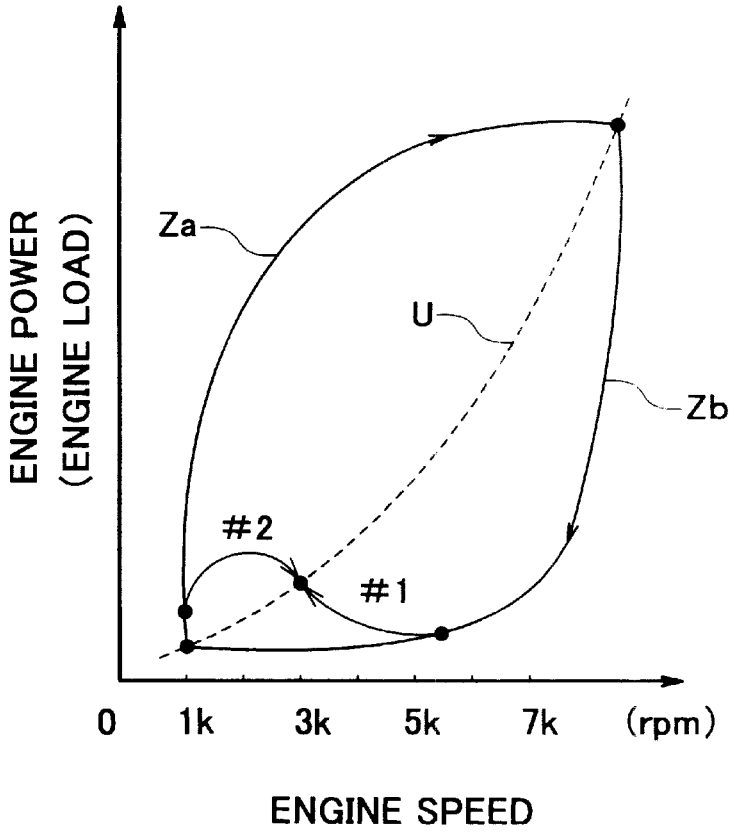
FIG. 30 is a graph showing a hysteresis characteristic between an engine speed and an engine power (engine load), and a propulsion force characteristic of a water jet pump associated with the hysteresis characteristic.

FIG. 30 is a graph showing a hysteresis characteristic between the engine speed and the engine power (engine load), with the engine speed on a lateral axis (1k represents "1000") and the engine power on a longitudinal axis. A dashed line U indicates the propulsion force of the water jet pump P. For example, when the rider performs throttle-open operation without the steering assist mode control, the engine speed is increased with a degree at which the throttle is opened and the engine power is increased along an ascending line Za. On the other hand, when the rider performs the throttle-close operation in the cruising state, the engine speed is decreased with a degree at which the throttle is closed and the engine power is decreased along a descending line Zb.

Here, it is assumed that the predetermined value at which the steering assist mode control starts is set to 5500 rpm. When the rider performs throttle-close operation when the watercraft is cruising at the engine speed larger than 5500 rpm, the engine speed is decreased in a relatively short time. If the steering assist mode is started when the engine speed is decreased to 5500 rpm, the engine speed is maintained at 3000 rpm (engine speed set under the steering assist mode control) or more upon the steering assist mode control being executed. Accordingly, the propulsion force sufficient to turn the watercraft is obtained (pattern #1). In this case, when the steering assist mode control starts, the watercraft is cruising at the engine speed larger than 3000 rpm, and therefore, the engine speed is decreased but the engine power is increased up to 3000 rpm on the dashed line U.

In the pattern #1, the engine speed is apparently decreased after the steering assist mode control is executed. In actuality, however, the engine speed to be decreased in a very short time is maintained at a level (3000 rpm on the dashed line U) at which the propulsion force sufficient to turn the watercraft is obtained. Depending on the controlled speed, there is a possibility that the engine speed becomes temporarily smaller than 3000 rpm.

When the steering assist mode control is executed in a state in which the engine speed is smaller than 3000 rpm, the engine speed is increased up to 3000 rpm on the dashed line U. Accordingly, the propulsion force sufficient to turn the watercraft is obtained (pattern #2). In this case, when the steering assist mode control starts, the degree at which the engine power is increased is relatively larger than the degree at which the propulsion force is increased, but the engine power is gradually decreased with an increase in the speed of the watercraft.

When the steering assist mode control is started in the state in which the engine speed is 5500 rpm or less on the descending line Zb of this embodiment, the engine speed can be decreased to 3000 rpm on the dashed line U by substantially changing the fuel injection timing, the ignition timing, or these timings and the fuel injection amount and without actually changing the position of the throttle.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embodied by the claims.

What is claimed is:

1. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump;

a steering operation means operating in association with the steering nozzle of the water jet pump;

a steering position sensor for detecting a predetermined steering position of the steering operation means;

a throttle-close operation sensor for detecting a throttle-close operation;

a cruising speed obtaining means for obtaining a cruising speed of the watercraft; and an electric control unit, wherein the electric control unit is adapted to increase an engine speed of the engine to a predetermined engine speed during the detection of the predetermined steering position by the steering position sensor and the detection of the throttle-close operation by the throttle-close operation sensor while changing an increasing speed of the engine speed according to the cruising speed obtained by the cruising speed obtaining means, and wherein the electric control unit is adapted to set correspondingly lower increasing speeds of the engine speed for higher obtained cruising speeds.

2. The jet-propulsion watercraft according to claim 1, wherein the electric control unit is adapted to change the increasing speed stepwise according to the change in the obtained cruising speed.

3. The jet-propulsion watercraft according to claim 1, wherein the cruising speed obtaining means comprises a cruising speed sensor for detecting the cruising speed of the watercraft.

4. The jet-propulsion watercraft according to claim 2, further comprising: an increasing speed table that prestores the increasing speeds of the engine speed corresponding to differing cruising speeds, and wherein the increasing speed table is adapted to divide a predetermined cruising speed range into a plurality of cruising speed ranges and store lower increasing speeds of the engine speed set correspondingly for higher cruising speed ranges, and wherein the electric control unit is adapted to read out the increasing speed according to the cruising speed obtained by the cruising speed obtaining means and increase the engine speed to the predetermined engine speed by the read out increasing speed.

5. The jet-propulsion watercraft according to claim 4, wherein the plurality of cruising speed ranges are set in the order from low to high, and a lower cruising speed range stores a higher increasing speed of the engine speed while a higher cruising speed range stores a lower increasing speed of the engine; and wherein when the obtained cruising speed is in the lower cruising speed range, the electric control unit is adapted to read out the higher increasing speed from the increasing speed table and increase the engine speed to the predetermined engine speed by the read out higher increasing speed, when the obtained cruising speed is in the higher cruising speed range, the electric control unit is adapted to read out the lower increasing speed from the increasing speed table and increase the engine speed to the predetermined engine speed by the read out lower increasing speed, and then, when the cruising speed decreases into the lower cruising speed range, the electric control unit is adapted to read out the higher increasing speed from the increasing speed table and increase the engine speed to the predetermined engine speed by the read out higher increasing speed.

6. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump;

a steering operation means operating in association with the steering nozzle of the water jet pump;

a steering position sensor for detecting a predetermined steering position of the steering operation means;

a throttle close operation sensor for detecting a throttle-close operation;

a cruising speed obtaining means for obtaining a cruising speed of the watercraft;

an electric control unit adapted to increase the engine speed to a predetermined engine speed during the detection of the predetermined steering position by the steering position sensor and the detection of the throttle-close operation by the throttle-close operation sensor while changing an increasing speed of the engine speed according to the cruising speed obtained by the cruising speed obtaining means, and wherein the electric control unit is adapted to change the increasing speed stepwise according to the change in the cruising speed; and an increasing speed table adapted to divide a predetermined cruising speed range into first, second, and third speed ranges which are set in the order from low to high, and store smaller increasing speeds set for higher speed ranges, and wherein when the obtained cruising speed is in the first speed range, the electric control unit is adapted to read out a first increasing speed from the increasing speed table and increase the engine speed to the predetermined engine speed based on the first increasing speed, when the obtained cruising speed is in the second speed range, the electric control unit is adapted to read out a second increasing speed smaller than the first increasing speed and increase the engine speed based on the second increasing speed, and then, when the cruising speed decreases to the first speed range, the electric control unit is adapted to read out the first increasing speed from the increasing speed table and increase the engine speed to the predetermined engine speed based on the first increasing speed, and when the obtained cruising speed is in the third speed range, the electric control unit is adapted to read out a third increasing speed smaller than the second increasing speed from the increasing speed table and increase the engine speed based on the third increasing speed, then when the cruising speed decreases to the second speed range, the electric control unit is adapted to read out the second increasing speed from the increasing speed table and increase the engine speed based on the second increasing speed, and then when the cruising speed decreases to the first speed range, the electric control unit is adapted to read out the first increasing speed from the increasing speed table and increase the engine speed to the predetermined engine speed based on the first increasing speed.

7. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump;

a steering operation means operating in association with the steering nozzle of the water jet pump;

a steering position sensor for detecting a predetermined steering position of the steering operation means;

a throttle-close operation sensor for detecting a throttle-close operation;

an obtaining means for obtaining one of a cruising speed of the watercraft and an engine torque of the engine and providing a corresponding value; and an electric control unit, wherein the electric control unit is adapted to increase an engine speed of the engine during the detection of the predetermined steering position by the steering position sensor and the detection of the throttle-close operation by the throttle-close operation sensor so that the cruising speed or the engine torque obtained by the obtaining means becomes a predetermined target cruising speed or engine torque while changing an increasing speed of the engine speed based on a difference value between the cruising speed obtained by the obtaining means and the predetermined target cruising speed or a difference value between the engine torque obtained by the obtaining means and the predetermined target engine torque, and wherein the electric control unit is adapted to set correspondingly lower increasing speeds of the engine speed for larger difference values.

8. The jet-propulsion watercraft according to claim 7, wherein the electric control unit is adapted to set the increasing speed lower when the difference value is larger than a predetermined value.

9. The jet-propulsion watercraft according to claim 7, further comprising: a target value table that prestores the predetermined target cruising speed according to the obtained cruising speed or the predetermined target engine torque according to the obtained engine torque, and wherein the electric control unit is adapted to refer to the target value table based on the cruising speed or the engine torque obtained by the obtaining means to obtain the predetermined target cruising speed or the predetermined target engine torque.

10. The jet-propulsion watercraft according to claim 7, further comprising: an engine speed sensor for detecting the engine speed, and wherein the obtaining means is adapted to calculate the engine torque from the engine speed detected by the engine speed sensor.

11. The jet-propulsion watercraft according to claim 10, wherein the obtaining means comprises a torque conversion table that prestores a relationship between the engine speed and the engine torque, and is adapted to refer to the torque conversion table based on the engine speed detected by the engine speed sensor to read out the stored engine torque associated with the detected engine speed.

12. The jet-propulsion watercraft according to claim 11, wherein the obtaining means comprises:

an offset table that prestores an offset value used for offsetting the torque stored in the torque conversion table according to an acceleration of the engine; and an acceleration obtaining means for obtaining the acceleration of the engine, wherein the obtaining means is adapted to read out the stored offset value associated with the acceleration of the engine obtained by the acceleration obtaining means, and wherein the obtaining means is adapted to offset the engine torque read out from the torque conversion table based on the read out offset value.

13. The jet-propulsion watercraft according to claim 12, wherein the acceleration obtaining means comprises:

an engine speed memory for sequentially storing the engine speed detected by the engine speed sensor in every predetermined time cycle;

an engine speed difference calculating means for calculating an engine speed difference between a first engine speed stored in the engine speed memory and a second engine speed previously detected and stored in the engine speed memory;

an engine speed difference memory for sequentially storing the engine speed difference calculated by the engine speed difference calculating means; and a cumulating means for cumulating the engine speed differences stored in the engine speed difference memory, and wherein the acceleration obtaining means is adapted to calculate the acceleration of the engine based on the cumulated difference value cumulated by the cumulating means.

14. The jet-propulsion watercraft according to claim 12, wherein the acceleration obtaining means comprises:

an engine speed memory for storing the engine speed detected by the engine speed sensor, sequentially and in every predetermined time cycle;

an engine speed difference calculating means for calculating an engine speed difference between a first engine speed stored in the engine speed memory and a second engine speed previously detected and stored in the engine speed memory;

an engine speed difference memory for sequentially storing the engine speed difference calculated by the engine speed difference calculating means; and a cumulating means for cumulating the engine speed differences stored in the engine speed difference memory, and wherein the acceleration obtaining means is adapted to calculate the acceleration of the engine based on the cumulated difference value cumulated by the cumulating means.

15. The jet-propulsion watercraft according to claim 7, wherein the electric control unit is adapted not to conduct combustion in part of or all of a plurality of cylinders of the engine for a predetermined time period in order to set the increasing speed lower.

16. The jet-propulsion watercraft according to claim 7, wherein the electric control unit is adapted to change at least one of an ignition timing and an injection timing in part of or all of a plurality of cylinders of the engine in order to set the increasing speed lower.

17. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump;

a steering operation means operating in association with the steering nozzle of the water jet pump;

a steering position sensor for detecting a predetermined steering position of the steering operation means;

a throttle-close operation sensor for detecting a throttle-close operation;

an engine speed sensor for sequentially detecting the engine speed; and an electric control unit, wherein during the detection of the predetermined steering position by the steering position sensor and the detection of the throttle-close operation by the throttle-close operation sensor, the electric control unit is adapted to judge whether or not a value associated with the engine speed detected in a second period before a first period between a point of the detection and a point before a given period from the point of the detection is larger than a predetermined value, and to increase the engine speed while judging that the value is larger than the predetermined value.

18. The jet-propulsion watercraft according to claim 17, wherein the value associated with the engine speed detected in the second period is a statistical value of a plurality of engine speeds detected in the second period.

19. The jet-propulsion watercraft according to claim 17, wherein the value associated with the engine speed detected in the second period is an average value of a plurality of engine speeds detected in the second period.

20. The jet-propulsion watercraft according to claim 17, wherein the first period is approximately 0.5 second.

21. The jet-propulsion watercraft according to claim 17, wherein the second period is approximately 3 seconds to 5 seconds.

22. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump;

a steering operation means operating in association with the steering nozzle of the water jet pump;

a steering position sensor for detecting a predetermined steering position of the steering operation means;

a throttle-close operation sensor for detecting a throttle-close operation;

a cruising speed obtaining means for obtaining a cruising speed of the watercraft; and an electric control unit, wherein the electric control unit is adapted to increase the engine speed upon an elapse of a delay time according to the cruising speed obtained by the cruising speed obtaining means after the steering position sensor detects the predetermined steering position and the throttle-close operation sensor detects the throttle-close operation.

23. The jet-propulsion watercraft according to claim 22, wherein the electric control unit is adapted to set the delay time directly proportional to the cruising speed obtained by the cruising speed obtaining means.

24. The jet-propulsion watercraft according to claim 22, wherein the cruising speed obtaining means comprises a cruising speed sensor, for detecting the cruising speed of the watercraft.

25. The jet-propulsion watercraft according to claim 22, further comprising:

a delay time table that prestores the delay time according to the cruising speed of the watercraft, and wherein the electric control unit is adapted to read out the delay time according to the cruising speed obtained by the cruising speed obtaining means from the delay table and delay start timing of increasing the engine speed by the delay time read from the delay time table.

26. A jet-propulsion watercraft comprising:

a water jet pump including an outlet port and a steering nozzle, said water jet pump pressurizing and accelerating sucked water and ejecting the water from an outlet port to propel the watercraft as a reaction of the ejecting water;

an engine for driving the water jet pump;

a steering operation means operating in association with the steering nozzle of the water jet pump;

a steering position sensor for detecting a predetermined steering position of the steering operation means;

a throttle-close operation sensor for detecting a throttle-close operation;

an obtaining means for obtaining a torque of the engine; and an electric control unit, wherein the electric control unit is adapted to increase the engine speed during the detection of the predetermined steering position by the steering position sensor and the detection of the throttle-close operation by the throttle-close operation sensor so that the torque of the engine obtained by the obtaining means becomes a predetermined target engine torque while changing an increasing speed of the engine speed based on a difference value between the engine torque obtained by the obtaining means and the predetermined target engine torque.

27. The jet-propulsion watercraft according to claim 26, wherein the electric control unit is adapted to set smaller increasing speeds for larger difference values.

28. The jet-propulsion watercraft according to claim 26, further comprising: an engine speed sensor for detecting the engine speed, and wherein the obtaining means is adapted to obtain the engine torque based on the engine speed detected by the engine speed sensor.

29. A jet-propulsion watercraft comprising:

a water jet pump including an output port and a steering nozzle, said water jet pump pressurizing and accelerating sucked water and ejecting the water from an outlet port to propel the watercraft as a reaction of the ejecting water;

an engine for driving the water jet pump;

an engine speed sensor for detecting an engine speed of the engine;

a steering operation means operating in association with a steering nozzle of the water jet pump;

a steering position sensor for detecting a predetermined steering position of the steering operation means;

a throttle-close operation sensor for detecting a throttle-close operation;

an obtaining means for obtaining an engine torque of the engine based on the engine speed detected by the engine speed sensor, wherein the obtaining means comprises a torque conversion table that prestores a relationship between the engine speed and the engine torque, and is adapted to refer to the torque conversion table based on the engine speed detected by the engine speed sensor to read out the stored engine torque associated with the detected engine speed; and an electric control unit, wherein the electric control unit is adapted to increase the engine speed during the detection of the predetermined steering position by the steering position sensor and the detection of the throttle-close operation by the throttle-close operation sensor so that the engine torque obtained by the obtaining means becomes a predetermined target engine torque while changing an increasing speed of the engine speed based on a difference value between the engine torque obtained by the obtaining means and the predetermined target engine torque.

30. The jet-propulsion watercraft according to claim 29, wherein the obtaining means comprises:

an offset table that prestores an offset value used for offsetting the torque stored in the torque conversion table according to an acceleration of the engine; and an acceleration obtaining means for obtaining the acceleration of the engine, wherein the obtaining means is adapted to read out the stored offset value associated with the acceleration of the engine obtained by the acceleration obtaining means, and wherein the obtaining means is adapted to offset the engine torque read out from the torque conversion table based on the read out offset value.

31. The jet-propulsion watercraft according to claim 30, wherein the acceleration obtaining means comprises:

an engine speed memory for sequentially storing the engine speed detected by the engine speed sensor in every predetermined time cycle;

a difference value calculating means for calculating a difference value between a first engine speed stored in the engine speed memory and a second engine speed previously detected and stored in the engine speed memory;

a difference value memory for sequentially storing the difference value calculated by the difference value calculating means; and a cumulating means for cumulating the difference values stored in the difference value memory, and wherein the acceleration obtaining means is adapted to calculate the acceleration of the engine based on the value cumulated by the cumulating means.

32. The jet-propulsion watercraft according to claim 30, wherein the acceleration obtaining means comprises:

an engine speed memory for storing the engine speed detected by the engine speed sensor, sequentially and in every predetermined time cycle;

a difference value calculating means for calculating a difference value between a first engine speed stored in the engine speed memory and a second engine speed previously detected and stored in the engine speed memory;

a difference value memory for sequentially storing the difference value calculated by the difference value calculating means; and a cumulating means for cumulating the difference values stored in the difference value memory, and wherein the acceleration obtaining means is adapted to calculate the acceleration of the engine based on the value cumulated by the cumulating means.

* * * * *